US005765761A

United States Patent [19]

Law et al.

[11] Patent Number: 5,765,761

[45] Date of Patent: Jun. 16, 1998

[54] ELECTROSTATIC-INDUCTION SPRAY-CHARGING NOZZLE SYSTEM

[75] Inventors: S. Edward Law; Steven C. Cooper, both of Athens, Ga.

[73] Assignee: Universtiy of Georgia Research Foundation, Inc., Athens, Ga.

[21] Appl. No.: 506,725

[22] Filed: Jul. 26, 1995

[51] Int. Cl.[6] ..... B05B 5/43

[52] U.S. Cl. ..... 239/690.1; 239/700; 239/706

[58] Field of Search ..... 239/690, 690.1, 239/700–8, 590; 118/629, 621

[56] References Cited

U.S. PATENT DOCUMENTS

| | | | |
|---|---|---|---|
| 3,516,608 | 6/1970 | Bowen et al. | 239/15 |
| 4,004,733 | 1/1977 | Law | 239/3 |
| 4,009,829 | 3/1977 | Sickles | 239/3 |
| 4,106,697 | 8/1978 | Sickles et al. | 239/705 |
| 4,343,433 | 8/1982 | Sickles | 239/3 |
| 4,664,315 | 5/1987 | Parmentar et al. | 239/704 |
| 4,735,364 | 4/1988 | Marchant | 239/690.1 |
| 4,762,274 | 8/1988 | Burls et al. | 239/3 |
| 4,991,774 | 2/1991 | Kelly | 239/708 |
| 5,044,564 | 9/1991 | Sickles | 239/690.1 |
| 5,181,661 | 1/1993 | Wollard | 239/704 |
| 5,188,290 | 2/1993 | Gebauer et al. | 239/707 |

OTHER PUBLICATIONS

Brochure entitled "What Growers Should Know About Air–Assisted Electrostatic Spraying," Spraying Systems, Inc. (1992).

S. Edward Law et al., "Advances in Air–Assisted Electrostatic Crop Spraying of Conductive Pesticides," 1992 International Summer Meeting, Paper No. 92–1062, The American Society of Agricultural Engineers (1992).

S. Edward Law, "Electrical Interactions Occuring at Electrostatic Spraying Targets," *Journal of Electrostatics*, Elsevier Science Publishers B.V. (1989), pp. 145–156.

S. Edward Law, "Electrostatic Pesticide Spraying: Concepts and Practice," *IEEE Transactions on Industry Applications*, vol. 1A–19, No. 2 (Mar./Apr. 1983), pp. 160–168.

S. Edward Law, "Embedded Electrode Electrostatic–Induction Spray–Charging Nozzle: Theoretical and Engineering Design," The American Society of Agricultural Engineers (1978) (reprinted from Transactions of the ASAE, vol. 21, No. 6, pp. 1096–1104(1978).

Brochure entitled "Electrostatic Sprayers for Greenhouses," Electrostatic Spraying Systems Inc. (no date).

Brochure entitled "Air–Assisted Electrostatic Vineyard Sprayers," Electrostatic Spraying Systems, Inc. (no date).

Brochure entitled "Electrostatic Sprayers for Field Applications," Electrostatic Spraying Systems, Inc. (no date).

*Primary Examiner*—Andres Kashnikow
*Assistant Examiner*—Lisa Ann Douglas
*Attorney, Agent, or Firm*—James L. Ewing, IV; Kilpatrick Stockton LLP

[57] ABSTRACT

The disclosed invention relates to electrostatic spraying systems for liquids and specifically to an improved spray-charging nozzle system having increased reliability, consistency, safety and power efficiency for long-term operation in harsh agricultural and industrial applications. The invention achieves these advantages by: a) management of the interaction of any externally-originating electric fields with the droplet-charging electric-induction field being applied within the nozzle, including partial or total exclusion of the former fields; b) maintenance of the charge-induction electric field at the droplet-formation zone by precluding or minimizing leakage of charge in all directions from the induction electrode; c) protection of electronic and nozzle components from damage due to inadvertent overcurrents; and d) facilitation of non-tedious, convenient, trouble-free inspection and cleaning of the nozzle under harsh field conditions.

40 Claims, 9 Drawing Sheets

ELECTROSTATIC-INDUCTION SPRAY-CHARGING NOZZLE SYSTEM

FIELD OF INVENTION

The present invention relates in general to the field of electrostatic spraying systems for liquids and in particular to electrostatic spray-charging nozzle systems.

BACKGROUND OF INVENTION

Spray charging is a necessary initial step in numerous electrostatic processes aimed toward altering and controlling the physical behavior and/or motion of fluid-borne particulates. Such processes are most commonly applied in gaseous fluids, such as air, but can also be applied in liquid media. Examples include, but are not limited to, the following: a) electrostatic coating, for example painting and pesticide spraying, in which charged droplets are assisted by electric forces in their movement toward, and deposition onto, a target surface to coat it efficiently with droplet-carried solid or liquid material laid down as either a continuous film or a uniformly distributed discrete-particle pattern; b) agglomeration of fluid-borne particulates by attraction onto injected charged droplets and/or collection onto oppositely charged droplets as in fog dispersal, fugitive-dust suppression and electrostatic wet-scrubbing of air-pollution emissions from stacks; c) stabilization and coalescence prevention by mutual repulsion of like-charged droplets to prolong the life of military obscurant clouds, airborne vaccines, and the like; and d) exploitation of the Rayleigh hydrodynamic instability phenomenon for achieving controlled rupture and secondary atomization of evaporating airborne droplets for use in fuel atomization, pesticide spraying, and other applications.

In all the above-mentioned operations, reliable and consistent spray charging to a sufficient magnitude (e.g., >3 mC/kg) is critical and must be accomplished in a manner that precludes hazards both to personnel and to explosive environments. The charging process, moreover, should not impose excessive electronic or other power demands, particularly for portable or mobile usages.

Many specific electrostatic processes deploy a large number of spray-charging nozzles. A tractor-mounted air-assisted crop-sprayer may typically include, for example, 20–80 such charging nozzles. These nozzles are expected to operate for long periods of time in various conditions, unattended or attended by only one unskilled worker. A schedule for maintenance and corrective actions for individual spray-charging nozzles to be performed more often than each half-day is impracticable, however. Thus, reliable and consistent operation must be ensured by inherent features of the spray-charging system. This is especially important in harsh agricultural and industrial environments, where nozzle surfaces are fouled by indigenous charged or uncharged airborne materials, as well as by accumulation of the charged-spray material.

Prior electrostatic coating systems have in many instances applied very high charging voltages, in the range of 5–90 kV, to electrodes of the nozzle. Many of these prior systems electrify already dispersed coating particles via attachment of air ions generated by gaseous electrical discharges-(e.g., corona) emanating from the high-voltage electrode. Others use very high voltage electrostatic-induction electrodes positioned externally to the spray nozzle. Safe and long-term successful use of such systems is generally restricted to the application of coating materials by skilled personnel in carefully controlled industrial settings.

Beneficially lower voltages, in the range of 2–3 kV, are required with encapsulated or embedded electrode induction systems, which transfer charge onto the droplet-formation region of a conductive or partially conductive liquid jet as it is pneumatically atomized from a continuous phase into a discrete particulate phase. In accordance with Gauss's law, when electric field lines are caused to concentrate most intensely upon the droplet formation region of the jet, free-electron surface-charge densities exceeding $10^8$ electrons/mm$^2$ can be induced for imparting charge onto the forming droplets. Using prior art nozzle geometry (e.g., U.S. Pat. No. 4,004,733 to Law), which incorporates a closely spaced electrode embedded within the internal nozzle air channel, 4 mC/kg charge-to-mass ratios can be attained at relatively low electrode voltages in the range of 3 kV. In addition, the encapsulation or embedment of the electrode within the charging nozzle precludes shock hazard, mechanical damage and misalignment. These advantages are afforded only by encapsulation or embedment of the electrode within the interior of spray nozzles having the droplet formation region entirely within the confines of the nozzle.

A further benefit of this internal air-atomizing nozzle is that since high-velocity air interacts with the liquid jet inside the nozzle to finely atomize the liquid into spray, there is residual energy in the air-carrier stream from such a nozzle to enable penetration of charged-droplets deep within electrostatically-shielded interior target regions to be coated, such as 3-dimensional targets with much interior surface. For example, agronomic plant canopies, deeply recessed manufactured parts, and the like may be properly coated.

Such purposeful incorporation of aerodynamic forces to complement electrostatic forces forms the design basis for the University of Georgia's hybrid air-assisted electrostatic spraying technology. The resulting technology is appropriate for penetrating and coating the electrically-shielded interior surfaces of 3-dimensional targets.

The prior art (Law) device forms the basis for air-assisted electrostatic spraying systems that have been developed and successfully commercialized as a hand-held unit for applying a wide range of chemicals, both in the liquid phase as well as in the form of powder in a water carrier, onto greenhouse crops. These small systems use only one or two nozzles under direct operator supervision, and incorporate sufficiently high air volumes and pressures to prevent fouling.

To make large multi-nozzle systems such as row-crop boom sprayers feasible, it is desirable to use less air and less electrical power per nozzle than is required by prior art systems. If the prior art encapsulated electrode nozzles (e.g., Law and U.S. Pat. No. 4,664,315 to Parmentar et al.) are used at lower air pressure or lower air volume, however, they easily become fouled with spray deposits in the electrode channel and on the outer surfaces of the nozzle. This fouling can damage the nozzle and wiring. Deposits of spray in the electrode area disrupt the spray pattern, change the droplet size, and reduce the level of spray charging significantly. Once the nozzle and wiring becomes fouled with conductive spray deposits, or deposits from the environment such as dust, the electrical power demand can easily increase 100-fold. Such power demands can damage the solid-state power supply circuitry that provides voltage for the induction electrode.

Consistent and reliable induction charging of spray requires that a suitably intense electric field be maintained at the surface of the droplet-formation zone of the nozzle's liquid jet. For a fixed electrode geometry, the field is created by maintaining an electric potential difference on a nearby body (i.e., an induction electrode) relative to the liquid jet in the droplet formation zone. The liquid jet and liquid source, for convenience and safety, are preferably maintained at or near ground potential. Consistent with the teachings of physics, electric flux lines can be envisioned as originating from unit positive electric charges on the electrode and terminating on unit negative electric charges on the jet. Flux lines can be concentrated, as desired, onto the actual droplet-formation zone of the jet and not onto the solid conduit (i.e., the liquid orifice tip) from which the liquid emanates. (Note that discussions regarding electric voltage polarity are presented for the case of a positively-charged induction electrode producing negatively-charged spray. This is for simplicity of description only, and all such discussions hold valid in reverse order for a negatively-charged induction electrode.) Consistent with liquid charge-relaxation properties and jet dynamics, electrons will be induced onto the droplet formation zone as numerically analyzed by Law (*Trans. American Society of Agricultural Engineers,* 1978, pp. 1096–1104).

Any effect that diminishes the ability to maintain the electrode-to-liquid jet potential difference, and the corresponding electric flux concentration onto the liquid at the atomization zone, will adversely affect both the reliability and the consistency of spray charging. Experience has revealed that a number of such detrimental effects are characteristic of prior art induction charging nozzles, including: a) suppression of the droplet-charging induction field at the negatively-charged jet caused by the negative space charge on the already-ejected spray cloud; b) reduction in positive induction-electrode voltage caused by excessive current demanded from the unregulated dc power supplies used to economically provide the induction potential; c) elevation of the liquid jet's potential toward that of the induction electrode when positive charge leaks from the electrode back along the contaminant and surface moisture paths to the liquid jet and subsequently upstream through the liquid supply column, causing an IR voltage drop from the liquid jet to ground potential for the case of electrically-insulating liquid nozzles having a poor ground or a ground connection made to the liquid column some distance upstream from the jet; and d) acute short-circuiting directly across the charging gap within nozzles, eventually causing permanent damage to electronic and nozzle components.

An additional limitation of present spray-charging nozzles, which indirectly exacerbates the above problems, is the tedious and inconvenient cleaning procedure they require due to their numerous individual parts, seals and hidden surfaces (e.g., Parmentar et al.). This characteristic leads to inadequate nozzle maintenance under harsh field conditions.

The presence of electric charge on the droplets of a spray cloud constitutes an electric space charge that establishes an associated electric potential distribution throughout the cloud and neighboring spaces. Space-charge potentials of magnitude exceeding 30 kV are routinely calculated within such charged spray clouds. In addition, numerous experiments at the University of Georgia have measured electric fields (i.e., the negative of the electric potential gradient) imposed by this space charge to exceed 3 kV/cm at the cloud's boundary away from the nozzle. Much greater space-charge electric fields are likely to be imposed in the concentrated region in the vicinity of the nozzle's forward opening.

For charging nozzles having induction electrodes disposed within dielectric housings, electric flux lines readily permeate the dielectric and interconnect between the cloud's space charge, the induction electrode's surface charge, and the liquid jet's surface charge. Superposition of the imposed space-charge potential onto the applied induction potential detrimentally alters both the direction and the magnitude of the electric field just off the surface of the droplet-formation zone of the liquid jet and, hence, diminishes the jet's induced surface-charge density. The spatial extent of the cloud's space-charge varies directly with its proximity to grounded surfaces. Such surfaces neutralize the charge by spray deposition and/or electrically obscure from the nozzle a portion of the charged droplets. Therefore, the severity of space-charge suppression of induction spray charging will correspondingly vary. This fact presents significant inconsistency in the charge-to-mass ratio, and hence the electrostatic-deposition enhancement,. of sprays being applied to target objects of varying spacing and geometry (e.g., agronomic crop plants).

For a newly cleaned charging nozzle spraying moderately resistive liquid (e.g., $10^5$ ohm cm) with generous atomizing air pressure/flow, the current demanded from the induction-electrode's power supply is typically of the same order of magnitude as the convective spray-cloud current carried from the nozzle (ca. 5–7 μA for liquid flows in the 60–150 ml/min range). The corresponding electronic power demand at 1 kV nozzle potential is 20 mW or less. Laboratory and field tests indicate that after prolonged spraying of certain common liquids at reduced air pressures, the current per nozzle drawn from the power supply may increase 100- to 1,000-fold into the milliampere range. This tremendous current increase has experimentally been shown to be caused primarily by charge leakage to ground across fouled insulator surfaces contiguous to the exposed induction electrode. In addition to the concomitant output-voltage reduction suffered by the unregulated power supply, the increased current also introduces concerns regarding personnel safety, as well as permanent degradation of insulating members by prolonged electrical tracking.

Leakage paths from the electrode to ground-may eventually become established across both internal and external nozzle surfaces; they may furthermore become established both upstream and downstream from the induction electrode. Over prolonged but reasonably required operational time spans, fouling traces of the liquid being sprayed, as well as impurities conveyed in the pressurized air, deposit and build up on internal channel walls, thus contributing to the establishment of these conductive internal paths. Even charging nozzles that allow field disassembly for maintenance and cleaning soon have their many interior surfaces and seals contaminated by handling in the harsh agricultural and industrial environments of their operation. Gross fouling occurs whenever unatomized liquid inadvertently drips directly from the liquid orifice onto internal channel walls in the absence of high-velocity air flow. Conductive paths form on the forward face and other external surfaces of the nozzle over time due to the electrophoretic deposition of a small fraction of the charged spray material, as well as other naturally charged atmospheric contaminants. Uncharged atmospheric contaminants are also attracted for deposition via dielectrophoretic forces active in the combined space-charge and electrode electric-field, which strongly converges onto the outer surface of the interposed dielectric housing. Of course, gravitational settling, inertial impaction and direct contact account for appreciable deposits of indigenous uncharged contaminants from the particulate-laden atmospheres of many harsh agricultural and industrial work environments.

In addition to the long-term buildup of contaminants causing chronic charge leakage from the induction electrode to ground, sudden short-circuiting to ground of the high-voltage source inadvertently occurs whenever a large contaminant particle or conductive liquid fully or partially bridges the charging-field gap within a nozzle. Such shorting by contact or arcing imposes severe current demands upon the high-voltage power supply, which often result in damage. The damage that can be experienced includes: a) electronic-component failure within the power supply; b) pitting and eroding of the edges of the induction electrode and/or the liquid fluid tip (perturbing liquid flow and making unwanted corona discharge across the charging gap more likely); and c) pitting, erosion and carbonizing of the previously smooth dielectric channel walls adjacent to the electrode (making unwanted turbulence-creating surface discontinuities in the droplet-charging zone).

No awareness of the space-charge suppression of induction spray charging has been found in the scientific/engineering literature, and no patents are known that provide and/or modify electrical shielding of an induction electrode from the suppressing effect produced by externally originating electric fields.

Prior art efforts have attempted to reduce the leakage of charge from high-voltage charging electrodes using two primary approaches, viz., by lengthening the pathway to earth from the exposed high-voltage electrode, and by applying aerodynamic energy to maintain the contiguous insulating surfaces in a moisture free condition. The prior art ignores upstream charge leakage and instead concentrates upon reduction of charge leakage downstream from the electrode along the nozzle's inner channel, across the outer forward face, and rearward to earth along the outer nozzle surfaces.

U.S. Pat. No. 4,004,733 to Law discloses the use of a gaseous slipstream in a converging channel to deflect charged droplets from the induction electrode embedded within a spray-charging nozzle, and to shear away any inadvertent deposition onto the electrode, as well as onto the downstream channel. The convergent air channel, however, causes internal turbulence and eventual deposition on the channel walls. U.S. Pat. No. 3,516,608 to Bowen et al. discloses an air-curtain to reduce charged dust deposition onto the counter-electrode of a corona-discharge-type dust-charging nozzle. U.S. Pat. No. 4,343,433 to Sickles is directed to the use of a secondary annular air jet to interrupt any downstream charge-leakage pathways which tend to become established around the forward face of the charging nozzle and then extend to ground along its outer surfaces. This remedy requires compressed-air flows, which are excessive for most portable spray-charging systems; it is nonetheless subject to charge transfer via corona or other types of electrical discharges across the narrow air-blast-interrupted annular gap. U.S. Pat. No. 4,009,829 to Sickles discloses external, grounded electrodes that lie within the radial shadow of externally positioned charging electrodes to reduce the tendency of charged particles to collect externally to the nozzle, as well as to increase user safety by making the exposed external high-voltage electrodes less likely to touch the operator or the grounded workpiece or the arc-over thereto. U.S. Pat. No. 4,664,315 to Parmentar et al. describes an outer surface of a spray-charging nozzle formed with an irregular (i.e., grooved) shape to lengthen the electrical path to ground along the external surfaces of the nozzle. In practice, these irregular shapes are difficult to clean to the degree necessary to prevent electrical pathways. Moreover, no attention has been directed to leakage pathways along internal surfaces of the nozzle upstream to the charging electrode.

SUMMARY OF THE INVENTION

The present invention relates to electrostatic spraying systems for liquids and, particularly, to an improved spray-charging nozzle system with increased reliability, consistency, safety and power efficiency for long-term operation in harsh agricultural and industrial applications. The improvements are directly applicable to pneumatic, internal-atomizing, electrostatic-induction spray-charging nozzles and generally to other electrostatic-induction charging devices. A nozzle system according to the present invention achieves the above-mentioned benefits and advantages by: a) management of the interaction of any externally-originating electric fields with the droplet-charging electric-induction field being applied within the nozzle, including partial or total exclusion of the former fields; b) maintenance of the charge-induction electric field at the droplet-formation zone by precluding or minimizing leakage of charge in all directions from the induction electrode; and c) protection of electronic and nozzle components from damage due to inadvertent overcurrents.

According to one aspect of the present invention, a liquid orifice tip is irremovably coupled to a body portion of the electrostatic-induction spray-charging nozzle device. The present invention recognizes that in prior art nozzles, liquid orifice tips have been removable to permit cleaning of the parts of the nozzle. However, removal of the liquid orifice tip can lead to the introduction of contaminants between the liquid orifice tip and the body portion, and this contamination has been discovered to create an undesirable current leakage path upstream to the liquid source. According to the present invention, prevention of the formation of this current leakage path is achieved by constructing the nozzle so that the liquid orifice tip is irremovably coupled to the body portion of the nozzle, i.e., that the liquid orifice tip can only be removed, if at all, with extreme difficulty so as to prevent users of devices including these components removing or otherwise tampering with them.

Accordingly, one embodiment of an electrostatic-induction spray-charging nozzle device of the present invention includes a body portion assembly adapted for use with an electrical power supply. The nozzle device is further adapted for use with a liquid source and a gas source upstream of a rearward end of the assembly, as well as an electrode cap coupled to a forward end of the assembly. The body portion assembly includes a body portion having a first channel for carrying a liquid from the liquid source and a second channel for carrying gas from the gas source. The body portion assembly also includes a liquid orifice tip irremovably coupled to the body portion, the liquid orifice tip having an aperture aligned to receive and discharge liquid from the first channel of the body portion, the liquid being discharged from the liquid tip so as to meet with the gas in a droplet formation zone and form an atomized spray cloud.

According to another aspect of the present invention, a barrier element is interposed between the induction electrode-to-droplet formation zone and the source of the externally originated electric field (e.g., the charged spray cloud) in order to minimize or preclude space-charge suppression of droplet charging due to the charged spray cloud. The degree of interception by the barrier of incident electric field lines is selectable, ranging from 100% for an uninterrupted conductive element to lesser degrees for perforated conductive elements (e.g., mesh screens, punched or striped conductors, etc.) and for semiconductive barrier elements. A partially intercepting barrier of a specifically chosen degree would be of benefit in those charged-spray applications where a nozzle providing a self-limited spray space-charge is desired (e.g., charged spraying in explosive atmospheres subject to spark ignition). By contrast, the 100% barrier intercepts all incident electric field lines and essentially decouples any external field effects from the thus protected induction electrode-to-droplet formation zone. A consistent droplet charge-induction field can consequently be maintained at the surface of the droplet-formation zone independently of both the spatial extent and intensity of the already ejected charged-spray cloud, as well as the proximity of the nozzle to grounded objects in its vicinity.

The barrier element can be maintained at a fixed electrical potential (i.e., voltage) relative to the droplet-formation zone of the liquid jet, or the barrier can be electrically unconnected, or "floating." In most cases, the jet will be grounded and the barrier's potential relative to earth may also be zero (i.e., the barrier is directly grounded), although provisions may be made to select and fix the relative potential up to a number of kilovolts of either positive or negative polarity. Since electric field lines terminate perpendicularly onto a conductor that establishes itself as an equipotential surface when placed in an electric field, even an electrically-floating barrier element could beneficially redistribute the space-charge field imposed at the droplet-formation jet.

The barrier element may be formed in a shape that preferably encompasses the induction electrode-to-droplet formation zone. For the axially symmetrical cylindrical geometry of common pneumatic-atomizing nozzles, a coaxially positioned cup-like barrier with concavity facing upstream to essentially enclose the droplet-formation zone is appropriate. The barrier element need not however be cup-shaped, but may also be generally disk-shaped (i.e., substantially washer shaped) for ease of manufacture and may be coupled to the forward end of the nozzle. A spray-exit aperture is provided on the centerline of the barrier element. The barrier is preferably positioned relative to the induction electrode at such a distance as to preclude direct electrical short-circuiting and to minimize the capacitance between these two electrical elements—thus minimizing stored electrical energy and associated electrical shock hazard.

To assure electrical isolation of a conductive barrier element from contact with any nozzle component other than its intended potential-maintaining conductor, the barrier may be completely encapsulated within the insulating dielectric material constituting this portion of the nozzle. This embedment may include a several millimeter thick continuous covering of the dielectric material around and over the entire outer surface of the barrier to prevent any charge exchange between the barrier and the charged spray cloud (e.g., by charged-droplet attraction/deposition and/or by space-charge-induced gaseous electrical discharge at the barrier's surface). It should be noted that, for nozzles of cast or molded dielectric construction, the barrier can be an interposed lamina of conductive or semiconductive material of like construction. Alternatively, the barrier element may be affixed by conventional means to the forward surface of the nozzle.

In operation, electrical charge opposite in sign to that of the ejected charged spray cloud will flow onto the encapsulated barrier via its potential-maintaining conductor. The quantity of charge induced onto the barrier will be appropriate to maintain it at its prescribed potential even in the presence of the charged spray cloud. For a well-insulated conductive barrier, charge flow will cease when a surface charge density $\sigma=\epsilon E$ consistent with Gauss's law has been established on the barrier. Only changes in the space-charge field E will cause momentary charge flux onto or off of the encapsulated barrier via its conductor. The transient speed of response for adjusting the charge on a barrier of capacitance C can be preselected according to the relation $\tau=RC$ (where $\tau$ is the time constant) by proper selection of the conductor's resistance R.

An electrostatic-induction spray-charging nozzle device for precluding or reducing space-charge suppression of droplet charging is adapted for use with a liquid source and a gas source upstream of a rearward end of the device, and is further coupled to an electrical power supply and to a reference voltage. The nozzle device comprises a body portion having a first channel for carrying liquid from the liquid source, a second channel for carrying gas from the gas source, and a liquid orifice tip having an aperture aligned to receive and discharge liquid from the first channel of the body portion. The liquid discharging from the liquid orifice tip meets with the gas in a droplet formation zone to form an atomized spray cloud that is ejected in a direction forward of the nozzle. The nozzle device also includes an electrode coupled to the electrical power supply and disposed in the vicinity of the droplet formation zone to create an electric field for electrically charging the atomized spray cloud as it is ejected to a location forward of the nozzle. The nozzle device further includes an electric field barrier disposed between the electrode and the charged spray cloud, for decoupling the electric field of the ejected spray cloud from the electric field of the droplet charging zone.

In some nozzle configurations, it may be desirable to utilize an electric field barrier in the form of a nozzle cover of a non-conductive or dieletric material such as a plastic. The nozzle cover may have any suitable configuration, such as one having a substantially disk-like shape having a spray aperture (i.e., a generally washer-shaped element). In this case, the electric field of the ejected spray is redistributed or decoupled from the field at the charging zone by the slightly conductive surface of the dielectric, which is exposed to the environment.

According to another aspect of the present invention, leakage of charge is precluded or minimized in all directions from the induction electrode in order to better maintain the electrode's potential and hence the charge-induction electric field at the droplet-formation zone of the liquid jet. Charge leakage is reduced from the electrode across internal nozzle-channel surfaces both upstream and downstream of the electrode, as well as across external surfaces of the dielectric nozzle body. Dripping of conductive spray liquid directly from the liquid jet's orifice onto the nozzle's internal insulating channel walls when air flow ceases is also prevented. While such fouling residues can build up over time, their remedy will be presented in a later-described section of invention directed to the solution of acute charge short-circuiting within the nozzle.

The present invention achieves current-leakage reduction by appropriate incorporation of nozzle components formed, without limitation, of low volume and surface conductivity and wettability, such as thermoplastic fluorocarbon resins such as polytetrafluoroethylene marketed under the trade name TEFLON® (herein called "PTFE-like" materials) to increase the electrical resistance of critical interior and exterior nozzle surfaces contiguous to the induction electrode, as well as to lengthen certain internal surface pathways to ground. At the same time, it eliminates alternate or parallel pathways by minimizing disassembleable nozzle components and seals via seamless or near-seamless dielectric construction of both the liquid orifice/nozzle body portion and the electrode cap portion of the charging nozzle.

The electrode cap portion, which has embedded within it all induction and barrier electrode components and their leads, readily detaches (e.g., by thread or cam) from the liquid orifice/nozzle body. This detachment mechanism allows a person to directly expose the liquid orifice and internal air-channels for field inspection and cleaning, without having to handle and thereby contaminate critical high-resistance surfaces or seals.

Encapsulation or embedment of the induction and barrier electrodes and their supply-lead connections completely within the improved low-electrical-leakage electrode cap may be accomplished by a number of methods including, but not limited to, the following: a) total embedment within PTFE-like material comprising the entirety of the electrode cap; and b) embedment of the electrodes/leads within a main region of less costly and more easily molded plastic, within and onto which are integrally joined minor regions of PTFE-like components forming the necessary high-resistance, non-soiling surfaces; and c) additionally, a properly positioned and sized cylindrical band area of the internal channel wall of a PTFE-like insert may be rendered conductive or semi-conductive (e.g., by vacuum deposition or carbon impregnation) to create thereon the induction electrode.

The present invention also incorporates one or more PTFE-like surfaces, such as bands or shields, forming a low-wettability and non-sticking portion of the outer or inner surfaces of the nozzle's dielectric electrode cap, body, or hoses and wires. Such high electrical resistance exterior bands or channel inserts effectively interrupt any charge flow from the induction electrode to ground via tracking across the outer or inner surfaces of the wires, hoses and nozzle itself, and aids removal of any contaminants that do inadvertently collect.

A further aspect of the present invention manipulates the liquid supply, its conduit, and its electrical grounding structure in order to reduce both acute and chronic leakage of charge from the induction electrode and thereby prevent nozzle short-circuiting damage. This, in turn, greatly reduces both the damaging effects of overcurrents directly traversing the charging gap and the long-term detrimental reductions in the induction droplet charging field.

Complete or partial liquid bridging across the charging gap under no-gas-flow conditions is precluded by an anti-drip auto-purge mechanism. This ensures that the liquid supply tube for a reasonable distance upstream of the liquid jet's orifice has all spray liquid extracted following shutoff of each spraying operation. (As an additional precaution against short-circuiting across the charging gap, a gas pressure-sensor switch shuts off the charging electrode's high voltage source whenever inadequate gas pressure/flow occurs.)

Upon liquid shutoff by appropriate valving, the anti-drip liquid extraction cycle can be provided by a number of methods including, but not limited to, the following: a) withdrawal of the liquid upstream by vacuum for temporary storage in a reservoir for later reuse; b) withdrawal of the liquid downstream by the inherent venturi suctioning characteristic of internal-atomizing pneumatic nozzles and disposal by a brief continuation of spray atomization (valving provides an opening, to the atmospheric pressure, of the upstream end of the segment of the supply tube to be evacuated); and c) displacement of the spray liquid for atomization out of the orifice utilizing one or more other pressurized fluids to purge the liquid-tube segment (e.g., pressurized air alone and/or a special-purpose cleansing/conditioning liquid forced from an upstream supply reservoir).

Another aspect of the invention purposefully utilizes a unique form of electrical resistance between the droplet-formation liquid jet and ground to limit overcurrent and the damage it can cause. Using a liquid orifice/nozzle body constructed of non-conductive material (including the seamless one-piece construction feature also disclosed herein) being fed by a well-sealed liquid supply tube, the ground connection to the liquid is made upstream in the tube a distance L from the jet. The resulting liquid column of cross-sectional area A and electrical resistivity $\rho$ thus imposes a specified resistance R between the jet and earth of magnitude $R=\rho L/A$, which is in parallel with the supply tube's resistance R'. Current flowing from the jet to earth will thus partition into components such that the liquid column conveys R'/R times that conveyed through the tube material. These two resistance values can be preselected to control the flow of charge between the jet and earth and prevent over-current damage. For $R'/R>500$, for example, the liquid column dominates the charge flow. The charge flow essentially ceases when the liquid tube is air-purged. During spray charging, any current flow, I, through the liquid column between the jet and ground causes the jet to elevate to a voltage IR above ground potential—towards the electrode's potential. Ideally, current I includes only the charge being supplied to the droplet-formation jet, which departs as a convection spray-cloud current transported away by the charged droplets.

With surface charge leakages from the electrode to the jet eliminated by the previously disclosed aspects of this invention, system parameters determining R are chosen so that, in general, the jet's potential elevates to no more than 5% of the electrode's applied potential $V_a$ (i.e., $IR \leqq 0.05\ V_a$); thus the induction spray-charging field at the jet is not significantly diminished. (Note: While liquid grounding can be easily made by connection of the resistive liquid tube to a grounded metal fitting placed a fixed distance L upstream, the distance can readily and conveniently be diminished or fine-tuned by insertion of a conductive ground wire inside the liquid feed tube extending downstream a selectable distance from the fixed fitting.) Sudden current overloads due to acute nozzle short-circuiting, however, are effectively impeded by the liquid-column resistance. For a multitude of similar spray-charging nozzles powered by a common high-voltage supply, over-current failure of a single nozzle simply shuts down its charging field without significantly affecting the voltage input into other nozzles. This improved method is in contradistinction to the more commonly used prior art methods of placing a single series resistor at the high-voltage power supply's output or inserting resistor components at the high-voltage input to each nozzle. The prior art methods undesirably shut down charging voltage to all nozzles on a common supply circuit when only one nozzle short-circuits. Moreover, the prior art methods necessitate high-voltage connectors, seals, etc. which are subject to failure in the usually wet, conductive spray environment. Embodiments of spray induction nozzles according to the present invention also recognize the need for personnel safety. Instead of using a limiting resistor at the output of the high-voltage power supply, they may utilize an electronic DC-to-DC convertor power-supply circuit of low wattage and low capacitance, which immediately ceases oscillation and output upon current demands approaching hazardous-shock levels.

The aforementioned and additional objectives, features, advantages and benefits of the presently disclosed invention will be apparent to those skilled in the art by considering the further detailed description of the invention presented via the text and illustrations in the following section.

DETAILED DESCRIPTION

The following discussion emphasizes several preferred embodiments of the invention. These specific embodiments are merely exemplary of the invention. The inventive concepts can also be embodied in other ways without departing from the spirit of the invention.

Figure 1:
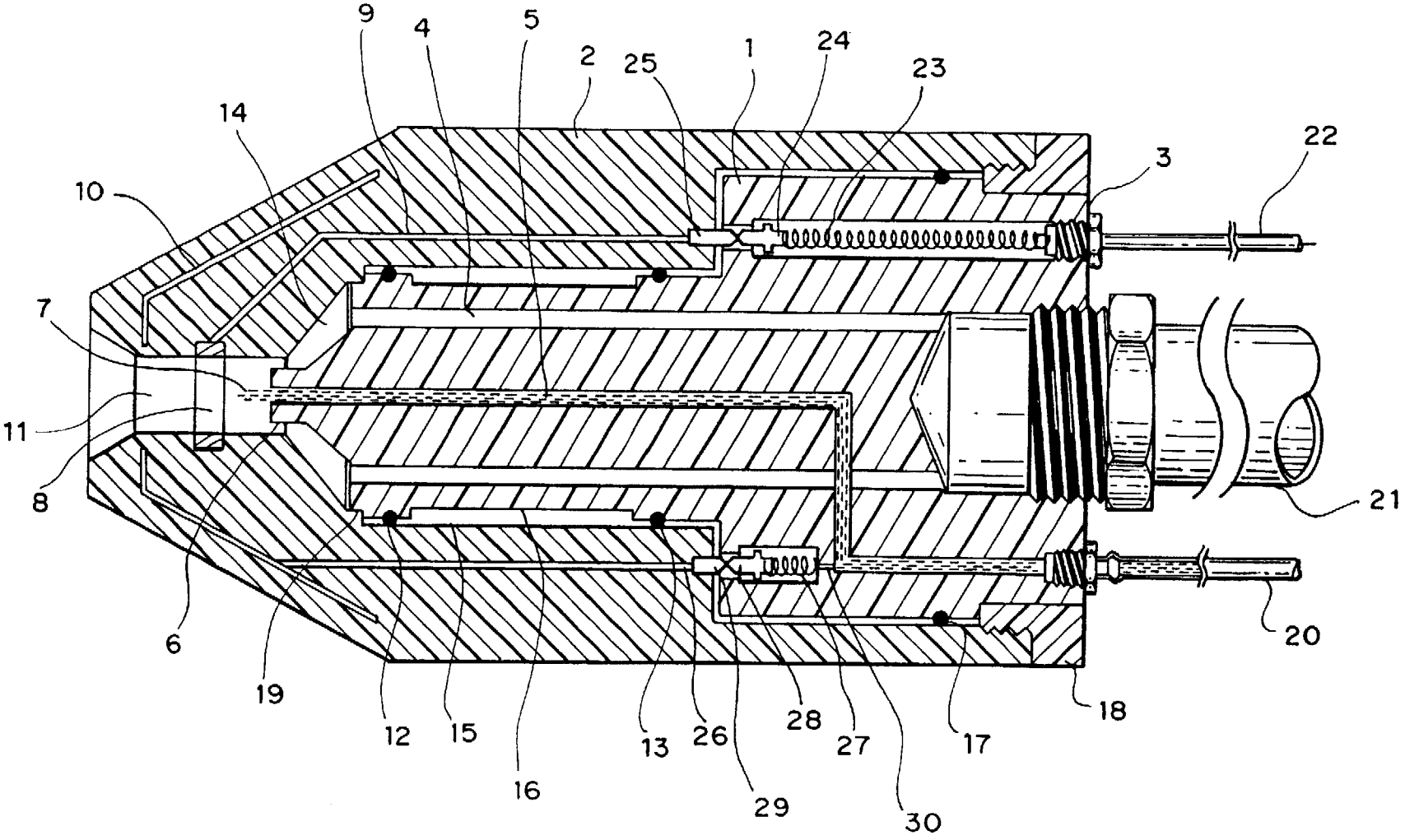
FIG. 1 shows a cross-sectional elevational view of a first embodiment of the induction spray charging nozzle apparatus according to the present invention, taken along the centerline of the apparatus.

One embodiment of the induction spray charging nozzle according to the present invention is shown in FIG. 1. In this embodiment, the nozzle broadly comprises a nozzle body portion 1 onto which is fastened an electrode cap portion 2. Economic considerations usually dictate that inexpensive construction methods and materials be used for electrostatic spraying systems requiring a multitude of charging nozzles.

Fabrication via plastic molding, for example, may produce low unit cost and excellent unit-to-unit dimensional accuracy. To provide low surface charge leakage, the dielectric material, for example, a castable or injection-molded plastic, a ceramic, or another material having dielectric properties, must exhibit extremely high volume and surface resistivity (e.g., $>10^{16}$ ohm m and $10^{18}$ Ω/sq., respectively), extremely low surface wettability (e.g., <0.01%/24 hrs.), no formation of carbonized conducting paths upon inadvertent arc-over, and very low surface adhesion providing for non-soiling. Without excluding other equally suitable materials, the thermoplastic fluorocarbon resins marketed under the trade name TEFLON® (including but not limited to TEFLON® PTFE, TEFLON® FEP, TEFLON® PFA, and TEFZEL® FLUOROPOLYMER) are examples of suitable nozzle materials. In the following sections, the term "PTFE-like" will be used as a generic term to denote any appropriate nozzle construction material providing the above-mentioned requisite properties and including but not limited to the above-mentioned materials. Preferably, the materials used in the nozzle's construction should not be readily flammable, and the term PTFE-like may (but does not necessarily) include materials possessing this additional characteristic.

Liquid to be discharged from the body portion of the nozzle exits via a liquid orifice tip 6 coupled to the forward end of the body portion 1. In prior art nozzles liquid orifice tips have been only removably attached to the body of the nozzle to facilitate cleaning of the nozzle. Removal of the liquid orifice tip can lead to the introduction of contaminants between the liquid orifice tip and the body portion. This contamination, it has been discovered, may create an undesirable current leakage path upstream to the liquid source. In order to prevent such current leakage, the nozzle may be constructed so that the liquid orifice tip is irremovably coupled to the body portion of the nozzle. "Irremovably" is intended here to mean that the liquid orifice tip cannot be readily removed, but only be removed with difficulty, in order to prevent users of devices including these components removing or otherwise tampering with them. Nozzle body portion 1 and the liquid orifice 6 may thus be formed in a seamless fashion from a single, continuous piece of machined or molded material. Alternatively, a liquid orifice tip 6 at the forward end of the body portion 1 could be a separate piece that is irremovably "press fit" or otherwise tightly coupled to the body portion 1. The absence of a seam between an integral liquid orifice tip 6 and the body portion 1, or, if the liquid orifice tip 6 is a separate piece, the tightly coupled interface between the two members, precludes the introduction of contaminant material and, consequently, the creation of a charge leakage path at that juncture.

The material from which the liquid orifice tip 6 is made is preferably a suitable dielectric material such as plastic or ceramic, and one having low surface wettability, such as a PTFE-like material. In addition, the material for the liquid orifice tip 6 and for other dielectric components of the nozzle preferably has not only the above properties, but also is not readily flammable, so as to prevent ignition during a short-circuiting event.

The nozzle body 1 receives the two fluids (atomizing gas and spray liquid) at its upstream rearward end 3 and properly transfers these fluids via internal gas 4 and liquid 5 channels to the downstream forward end which incorporates the liquid orifice tip 6. Liquid issues from the liquid orifice tip 6 as a continuous jet 7 of typically ca. one to several millimeters length where, in this droplet-formation zone, high-velocity gas interacts with the liquid jet to cause spray atomization.

As taught by Law (see *Trans. American Society of Agricultural Engineers*, 1978, pp. 1096–1104; U.S. Pat. No. 4,004,733), a charged electrostatic-induction electrode 8 properly positioned in relation to the liquid jet 7, and not encompassing the orifice tip 6, induces electric charge of sign opposite to that of the induction electrode 8 to flow from earth onto the jet 7. The charge concentrates in the jet's extremity, where atomization separates charged discrete-phase droplets from the liquid-jet continuum. The dielectric electrode cap portion 2 has embedded within it the properly positioned induction electrode 8. The inner cylindrical surface of induction electrode 8 forms a segment of the outer flow channel coaxially surrounding the liquid jet that is smooth and lacks gas-flow-perturbing surface discontinuities. The conductor 9 electrically connects the induction electrode 8 to a source of elevated voltage needed to provide to this electrode a difference in electric potential with respect to the liquid jet 7.

Various aspects of the present invention ensure that the electric field imposed upon the liquid surface of the droplet formation zone of the liquid jet 7, as a result of the potential difference between induction electrode 8 and the liquid jet 7, is reliably and consistently maintained at a maximum value, achieving spray-droplet charge-to-mass ratios in the tens of millicoulombs per kilogram. The electric-field barrier 10 of FIG. 1 includes one such aspect of the invention. In particular, electric field barrier 10 acts to fully or partially decouple, from the droplet-charging zone of the liquid jet 7, the electric-field-suppressing effect of the charged spray cloud in the nozzle's forward vicinity. In the embodiment shown in FIG. 1, a pneumatic atomizer of axially symmetrical cylindrical geometry, a cup-like barrier 10 with concavity facing upstream, and having a minimum sized spray-exit aperture 11, effectively intercepts, to the degree chosen, the influence of externally originating electric fields. As stated earlier, the geometry of the barrier including its degree of "openness," its dielectric and conductivity characteristics, and the electrical resistance R of its electrical connecting member 26, which connects it to its reference potential (including but not limited to earth voltage), may be selected in order to meet specific charged-spraying requirements. As illustrated, the barrier 10 is completely encapsulated within the (PTFE-like) dielectric construction of the electrode cap 2, precluding charge exchange via any path other than its electrical connecting member 26. As an alternative to the encapsulated cup-like barrier element pictured, a plastic shroud or housing enclosing the electrode cap 2 can be installed to provide an appreciable degree of external-field decoupling. This decoupling is contingent upon proper selection of the electrical properties of the shroud or housing and/or the conductivity of its surface. For instance, a plastic cover (discussed below in connection with alternative embodiments of the present invention) may provide significant shielding as a result of the presence of slight surface conductivity due to environmental surface films.

FIG. 1 illustrates one means for connecting the induction-charging electrode 8 and the field barrier 10 to their respective sources of electric potential. One or more O-ring or other resilient-type seals, e.g. 12 and 13, are provided to completely block the rearward seepage of atomizing gas and/or spray liquid from the gas plenum chamber region 14 back onto the extended inner-bore surface 15 of the electrode cap 2 and the outer surface 16 of the nozzle body 1. Other seals 17 prevent entry and forward movement of surface contaminants at the rear juncture of the electrode cap 2 and the nozzle body 1. A threaded retainer ring 18, acting in conjunction with the smooth seating-face shoulder 19 of the nozzle body 1, may be used to provide further compressive sealing and seating, ensuring accurate axial and radial positioning of the charging electrode 8 with respect to the liquid jet 7.

In the region at the rear face 3 of the nozzle body 1, nozzle inputs of spray liquid, atomizing gas and charging voltage enter via conduits or cables 20, 21 and 22, respectively, embedded, cemented or otherwise completely sealed against mass and charge leakage. The power supply itself may be mounted in the nozzle dielectric. Charging voltage may be forwardly transferred through the nozzle body 1 via a compressive conductor 23, terminating onto a recessed conductive shouldered button-type contactor 24. This compressive contactor 24 makes an electrical connection with the conductive rigid contactor 25, which penetrates into the recessive hole restraining the button-type contactor 24. The forward contactor 25 is rigidly embedded, pressed or attached in a rearwardly protruding manner into the inner shouldered section of the electrode cap, where it electrically connects with the charging electrode's conductor 9. In like fashion, the field barrier's electrically connecting member 26 makes contact, via compressive conductor 27 and contactors 28 and 29, with its source of reference potential.

The retainer ring 18, inner seals 12, 13 and 17, seating face 19, and compressive electrical connectors 23 and 27 facilitate rapid and easy detachment of the electrode cap portion 2 of the nozzle assembly from its mating nozzle body portion 1 for inspection, cleaning, etc. Precisely aligned reassembly ensuring correct electrical connection of the charging electrode 8 and the field barrier 10 to their respective potential sources can be provided by various methods (not pictured) including, but not limited to, mating axially aligned grooves/protrusions in the nozzle body 1 and the electrode cap 2 portions of the charging nozzle, differing lengths of protrusion of the forward rigid contactors 25 and 29 rearwardly from the shoulder, and placement of the electrical 22 and liquid 20 inputs at other than 180° angular separation on the rear face 3 of the nozzle body.

The example spray-charging nozzle of FIG. 1 illustrates one of a number of various methods for connecting the field-barrier 10 with its reference electric potential. For the method shown, the compressive connector 27 contacts a liquid-tight sealed machine screw or other pressed conductive member 30, which penetrates into the liquid channel 5 of the nozzle body 1 to electrically connect, via the conductive liquid, the barrier 10 with a reference potential equal or nearly equal to that of the liquid jet 7.

Figure 2:
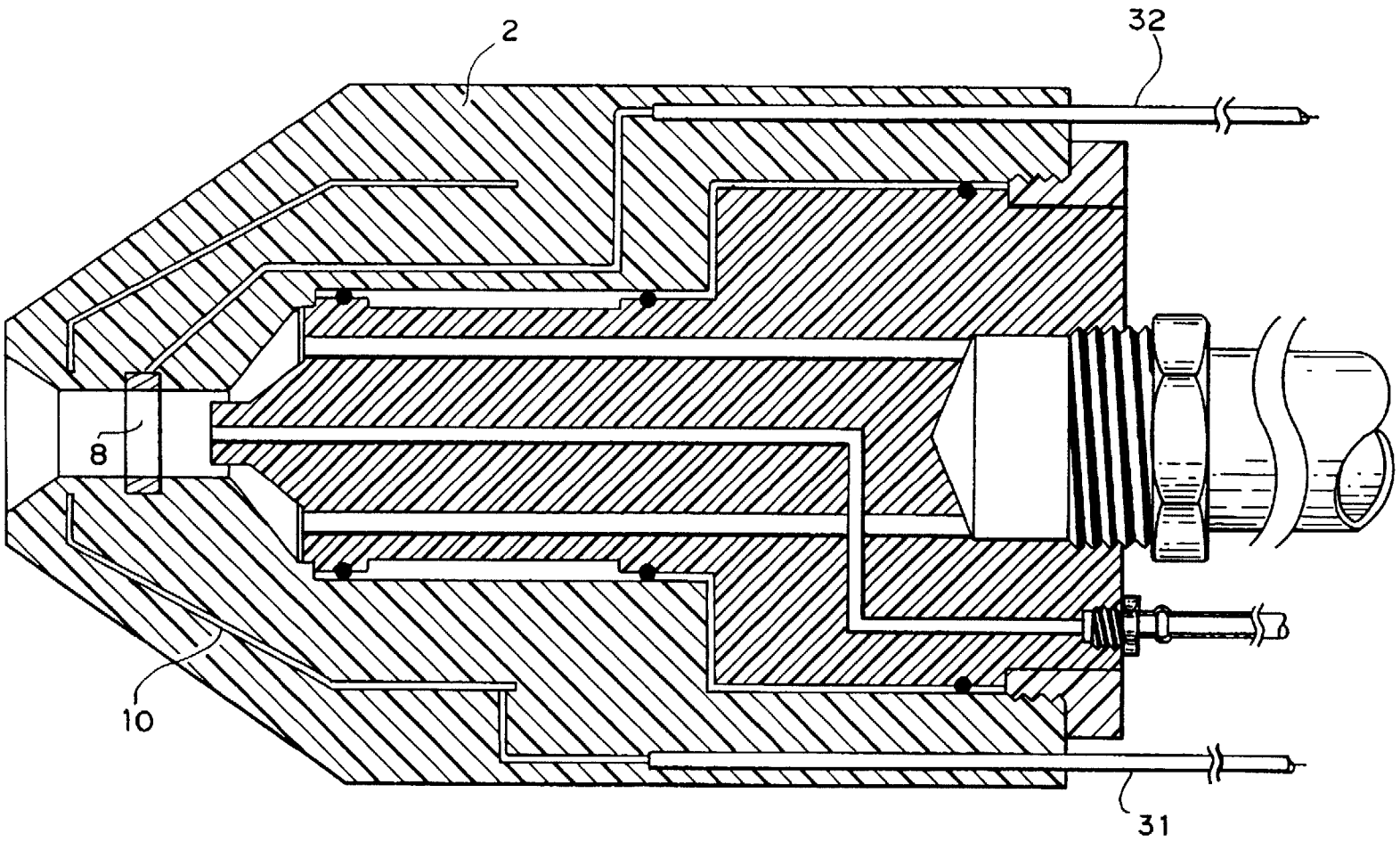
FIG. 2 shows a cross-sectional elevational view of a second embodiment of the induction spray charging nozzle apparatus according to the present invention, taken along the centerline of the apparatus.

FIG. 2 illustrates a configuration for interconnecting the field barrier 10, as well as the charging electrode 8, to their respective sources of electrical potential by a method using no exposed, non-embedded-in-dielectric, conducting members within the electrode cap 2. Electrical conductor cables 31 and 32 extend with uninterrupted electrical-insulation sheaths covering them from deeply within, and sealed to, the electrode cap 2 generally rearward to moisture-tight quick-connections at their respective sources of electrical potential located well removed (e.g., 30—100 cm) from the zone of airborne spray. In contrast to the retainer-ring/compressive electrical-connector method of FIG. 1, the method of FIG. 2 does not require angular alignment of the electrode cap 2 portion relative to the liquid orifice/nozzle body portion 1, thus eliminating alignment grooves, etc. and permitting use of a variety of charging-nozzle quick-assembly means, such as quarter-turn threads with spring detents, cam actions, etc.

Figure 3:
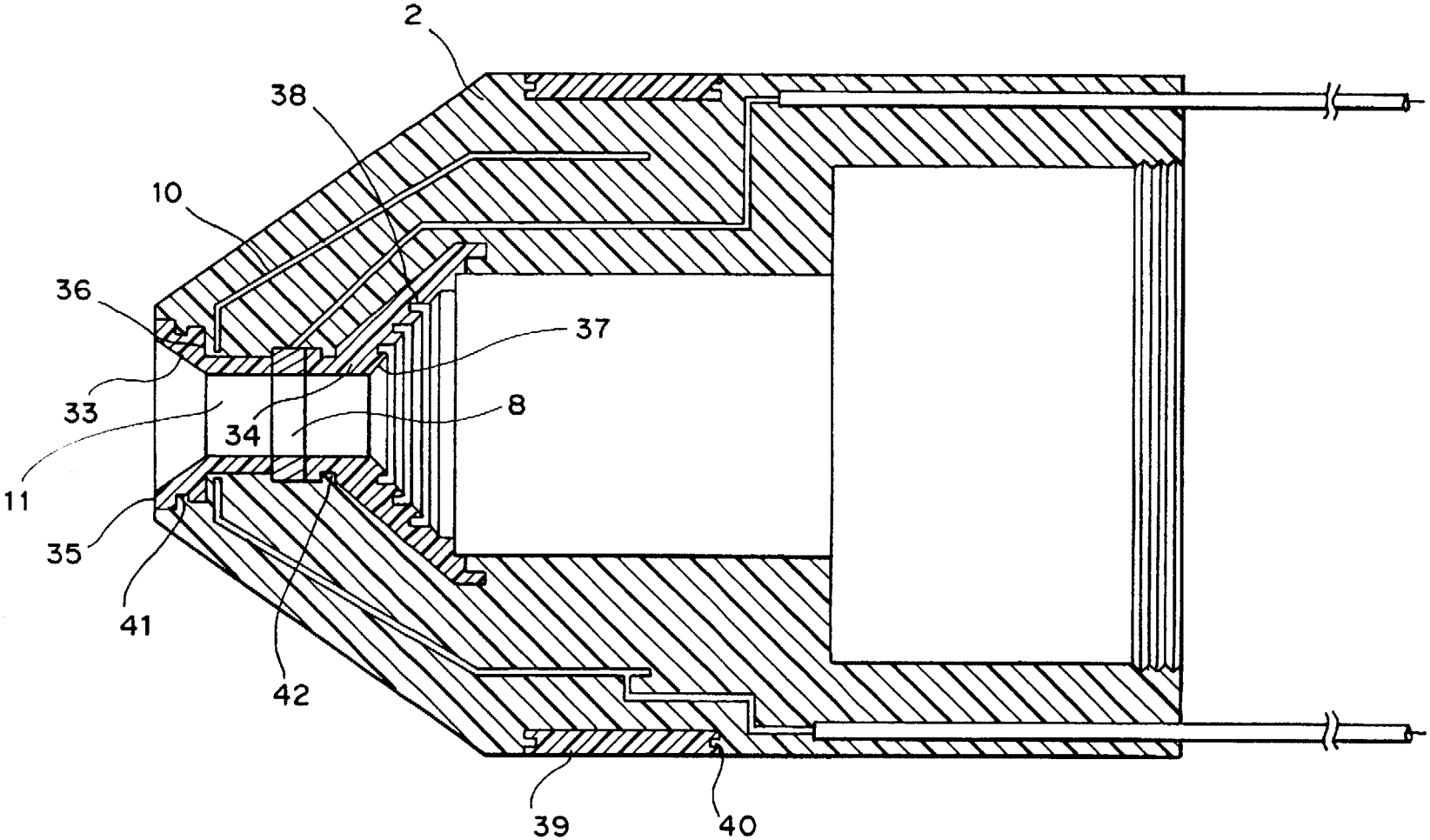
FIG. 3 shows a cross-sectional elevational view of a PTFE-like channel insert and a PTFE-like external cylindrical sleeve in the context of an embodiment of the induction spray charging nozzle apparatus according to the present invention.

FIG. 3 shows an embodiment of a two-piece PTFE-like channel insert (components 33 and 34) according to the present invention, that economically provides the desired high surface resistivity and low wettability characteristics upstream and downstream from the induction electrode 8 and which extends forward to form the face 35 of the electrode cap 2 portion of the spray-charging nozzle. The forward component 33 of the channel insert slides through the aperture 11 of the field barrier 10 and, with its shoulder 36, facilitates convenient and accurate positioning of the barrier during fabrication of the electrode cap. The rearward component 34 of the channel insert continues upstream to form the forward wall 37 of the nozzle's atomizing-gas plenum 14. Formed within this wall is a grooved or multigrooved labyrinth 38 to lengthen the upstream surface path between the induction electrode and the liquid jet.

On the external surface of the electrode cap 2, one or more PTFE-like cylindrical sleeves 39 are incorporated to provide easily cleaned surface bands of low-wettability and non-soiling properties for interrupting charge-leakage paths which tend to form from the nozzle face 35 rearwardly to external grounded components in the vicinity of the nozzle's attachment bracket, etc. Properly incorporated circular grooves 40 on the end surfaces of the cylindrical sleeves 39 and on the outer cylindrical surfaces 41 and 42 of the two channel insert components, ensure mechanical charge-leakage-free joining of these PTFE-like components with the castable plastic forming the remainder of the electrode cap 2. As a possibly less expensive alternative to the cylindrical sleeves 39, any manner of providing a surface of low-wettability could be used, for example the application of a coating or a tape of a suitable material.

Intimate joining, in both a mechanically secure and a charge and fluid leak-free manner, of the PTFE-like insert 33, 34 and the castable-plastic nozzle electrode cap 2 is provided at their interface by: a) proper selection of the respective thermal expansion coefficients to ensure, during operation in hot environments, that the PTFE-like insert's fractional expansion either equals or slightly exceeds that of the castable plastic to preclude any loosening of the insert (e.g., respective coefficients of thermal expansion for PTFE and a typical castable epoxy-resin Emerson and Cuming Stycast #2651-40 are approximately $50\times10^{-6}$ in./in. °F. and $27\times10^{-6}$ in./in. °F.); b) circular grooves around the outer periphery of the PTFE-like insert to create an interdigitating junction of the two plastic materials which will preclude axial movement of the insert and electrode elements; and c) proper surface treatment (e.g., etching of the outer insert surface to ensure its bonding with the castable plastic along their interface.

Figure 4:
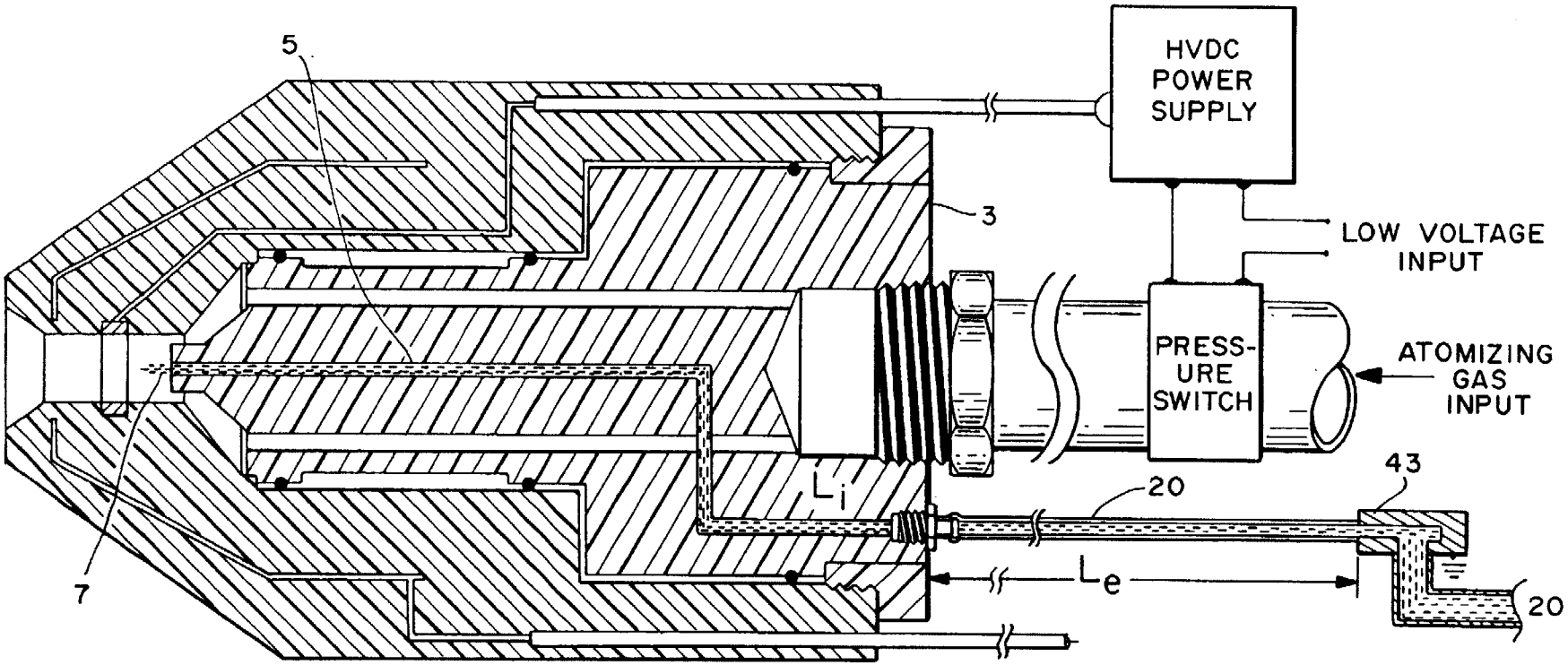
FIG. 4 shows a cross-sectional elevational view of an embodiment of an aspect of the present invention for preventing acute nozzle short circuiting damage and reducing the formation of chronic charge leakage paths.
Figure 5:
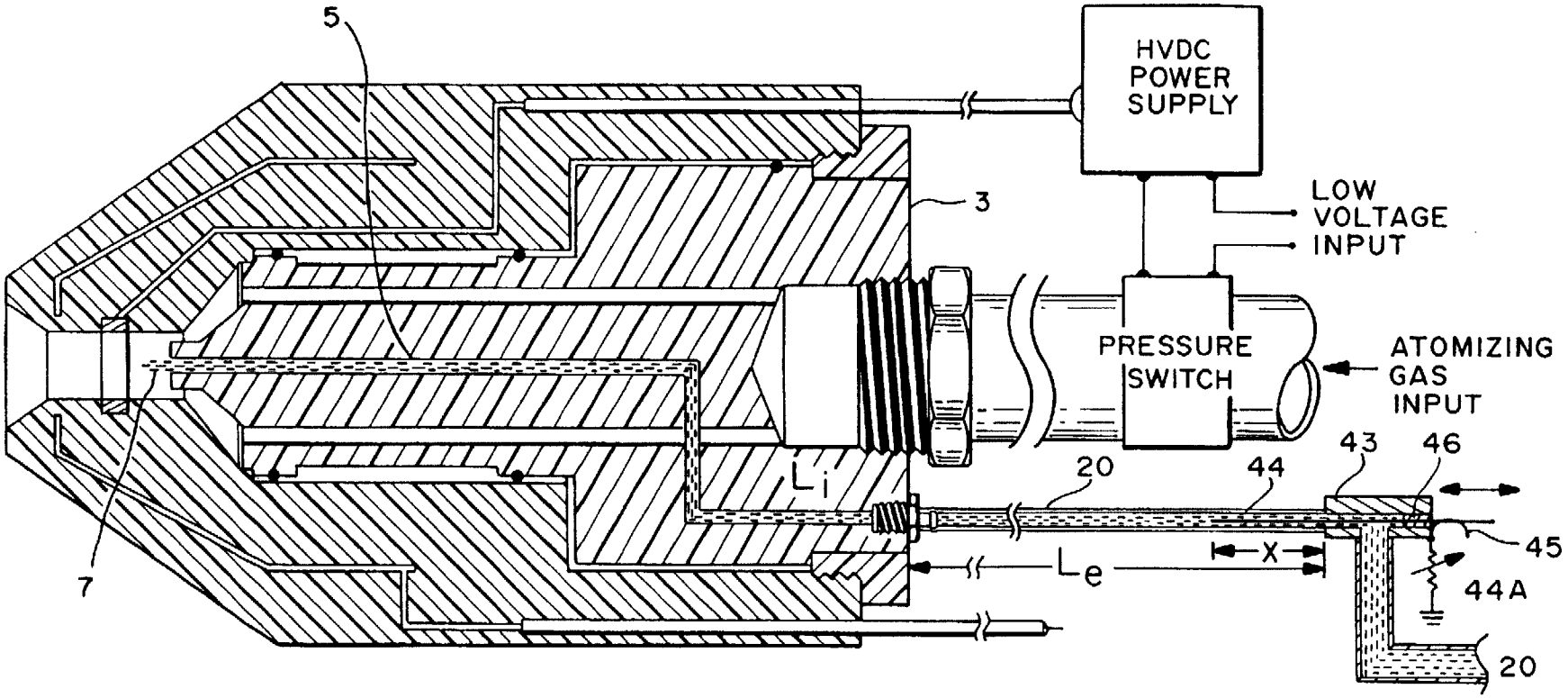
FIG. 5 is a cross-sectional elevational view of another embodiment of an aspect of the present invention for preventing acute nozzle short circuiting damage and reducing the formation of chronic charge leakage paths.
Figure 6:
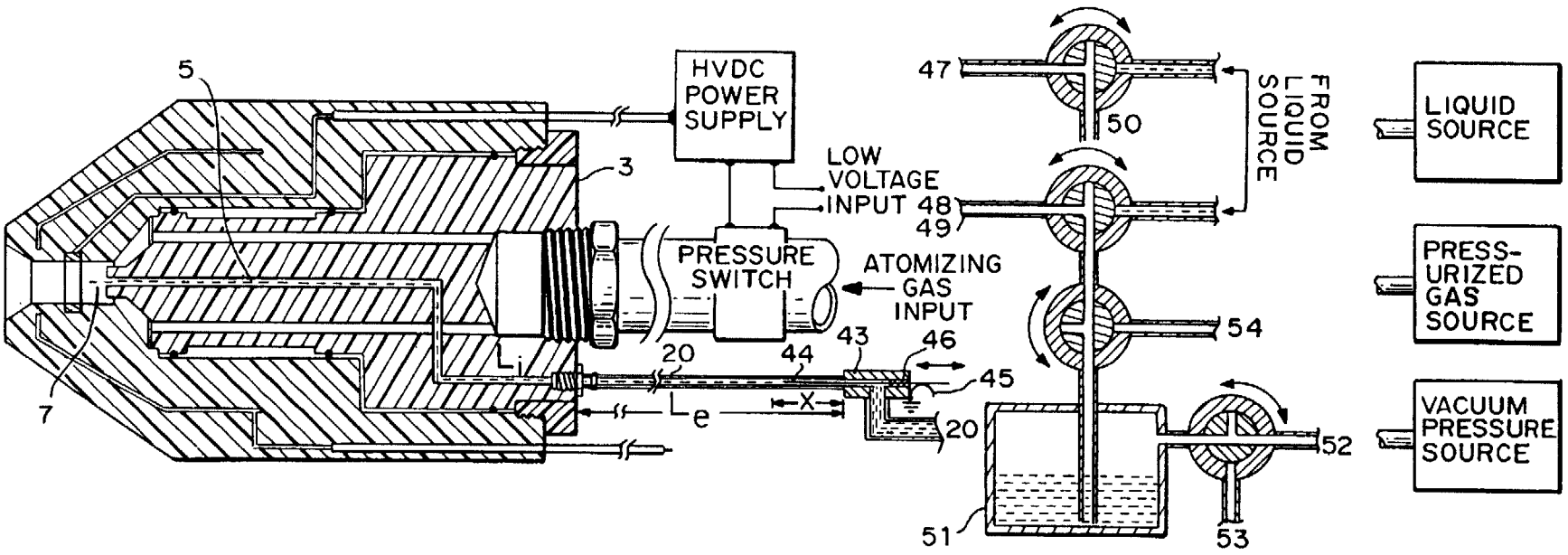
FIG. 6 is a cross-sectional elevational view of another embodiment of an aspect of the present invention for preventing acute nozzle short circuiting damage and reducing the formation of chronic charge leakage paths.

FIGS. 4–6 illustrate embodiments of aspects of the present invention that prevent acute nozzle short-circuiting damage, and reduce the formation of chronic charge-leakage paths, by manipulating the liquid supply, its conduit and its method of grounding. As shown in FIG. 4, a conductive tube fitting 43 (e.g., a metal tube coupling, elbow, tee, etc.) of the liquid supply tube 20 installed at external distance $L_e$ upstream from the rear face 3 of the charging nozzle provides grounding of the droplet-forming liquid jet 7 through a continuous length $L=L_i+L_e$ of liquid column existing within the tube and within the nozzle's internal liquid channel 5 of length $L_i$. The electrical resistance R from the jet to earth can be optimally chosen for system protection by judicious selection of the combined length L, the liquid-column area, A, and the resistivity of the walls of the liquid supply tube 20 in relation to the electrical resistivity of the spray liquid. For a broad range of spray liquids having somewhat similar resistivity values, installation of the grounded segment into the supply tube at a fixed common upstream distance $L_e$ may be quite satisfactory. Other fixed $L_e$ length-values can be selected for other different broad ranges of spray-liquid resistivity to be charged.

Alternatively, as shown in FIG. 5, a conductive grounded element 44 (e.g., a flexible stainless steel wire, either grounded directly or through an element having a specified resistance) may be inserted into the liquid column and extended downstream a variable distance, x, in order to conveniently provide a "fine-tuned" length $L=L_i+L_e-x$, optimally chosen for the specific spray liquid. The insertion element 44 is grounded by a simple spring contactor 45 or other means prior to its passage through a leak-proof packing 46 in tube fitting 43 (which in this embodiment need not be conductive), in the form of a tee or other suitable type of tube fitting. To permit even further control over the electrical resistance between the liquid jet and the earth, insertion element 44 may be coupled via spring contactor 45 to a selectable value resistor 44A, which is in turn connected to ground. In this configuration, the length x of insertion element 44, the resistance of selectable value resistor 44A, or both of these parameters, may be adjusted to control the overall resistance of the liquid jet 7 to earth.

For further convenience, the insertion element 44 may be in the form of a flexible-wire coil wound upon an earthed spool (not shown) housed in the vicinity,. or as a part of, the tube fitting 43. Such a spool-stored insertion element incorporating a calibrated rotary dial facilitates known and replicable insertion distances, x.

The liquid input tube 20 of FIGS. 4 and 5 interconnects, as shown in FIG. 6, to the spray-liquid source via an anti-drip, auto-purge mechanism connected in series as at tube 47, 48 or 49. These example mechanisms, without limitation, ensure that the liquid supply tube 20, for a reasonable distance upstream of the liquid jet's orifice, has all spray liquid extracted following shutoff of each spraying operation. This extraction precludes channel wetting by liquid dripping from the orifice, and interposes a high-resistance path from the orifice to earth for high-voltage power-supply relaxation and protection. By appropriate sequencing of multiple valving (not discussed in detail here but understandable from FIG. 6 by a person of ordinary skill in the art), the anti-drip, auto-purge invention is achieved by connection of input tube 20 to one of the following:

(a) tube 47: this mechanism withdraws the spray liquid by a downstream movement provided by the inherent venturi suctioning of the internal-atomizing pneumatic nozzle and disposal by a brief continuation (e.g., several seconds) of spray atomization. Valve port 50 provides an opening to clean atmospheric pressure (e.g., via a particulate filter, not shown) for the upstream end of the segment of the supply tube to be evacuated;

(b) tube 48: this mechanism uses vacuum pressure to withdraw the liquid by an upstream movement for temporary storage in a small reservoir 51 for later reuse. Vacuum pressure may conveniently be provided at valve port 52, without limitation, by: (1) an engine manifold of a tractor propelling an assembly of nozzles; (2) a venturi; or (3) a small vacuum pump (none of which are shown). Valve port 53 provides pressurized gas to force the collected liquid back downstream for reuse, or alternatively, provides an opening to atmospheric pressure for return of the collected liquid to the nozzle via the nozzle's inherent venturi suctioning; or c) tube 49: this mechanism is similar to the preceding one, but provides displacement of the spray liquid for atomization out the orifice utilizing one or more pressurized fluids to purge the liquid tube (e.g., pressurized gas alone through valve port 54 or a special-purpose cleansing/conditioning liquid venturi-suctioned or forced from upstream supply 51) followed by a clearing of the tube to the orifice by applying clean atmospheric pressure or pressurized gas via valve port 54.

Figure 7:
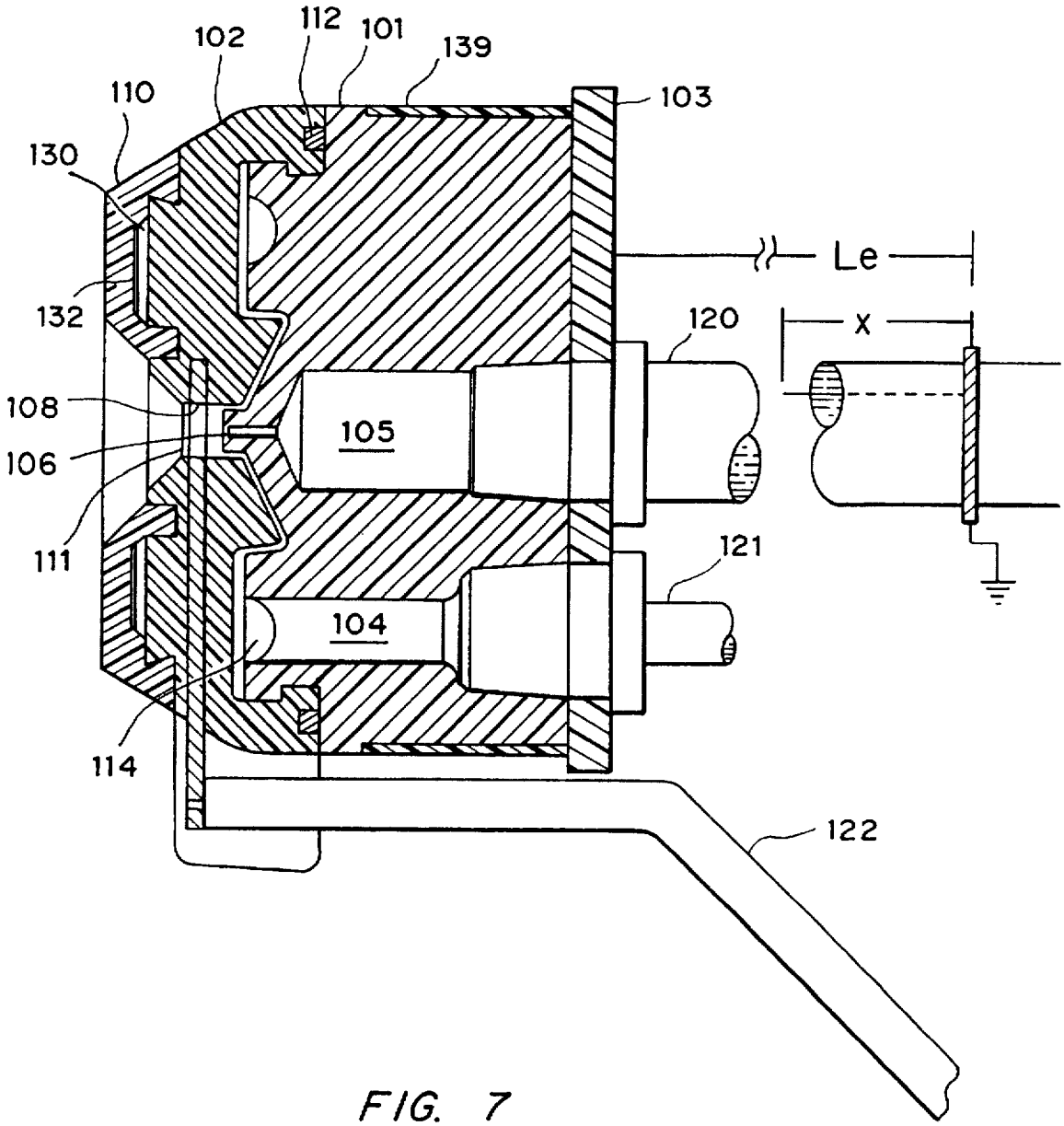
FIG. 7 is a cross-sectional elevational view of an additional embodiment of the induction spray charging nozzle apparatus according to the present invention.

In addition to the ones shown in FIGS. 1 and 2 and described in the accompanying text, many other embodiments of the nozzle according to the present invention are possible. In FIG. 7, for example, one alternative embodiment of the nozzle is shown. In this embodiment, many of the components are analogous to those of the embodiments of FIGS. 1 and 2, but differ in their geometry. These components are identified by reference numerals similar to those that identify the analogous components of FIGS. 1 and 2, but are counted from 100 to indicate that they relate to a different embodiment.

The embodiment of the nozzle shown in FIG. 7 includes a nozzle body portion 101, which can be formed from a single piece of machined or molded dielectric material. Body portion 101 may include a liquid orifice portion 106, from which a liquid jet issues, as described above. The liquid orifice portion 106 is most preferably joined to body portion 101 in such a manner as to minimize the likelihood of its being removed after assembly; it may for example be formed integral to body portion 101 (as shown in FIG. 7), be press-fit into body portion 101, or be joined by any known means for snugly coupling mechanical components to preclude or minimize the likelihood of their disassembly. The seamlessness or near-seamlessness resulting from the integral or snugly coupled structure prevents or minimizes the likelihood of the introduction of surface contaminant matter between the body portion 101 and the liquid orifice 106, and consequently minimizes the possibility of the formation of an electric charge leakage path in an interface between the body portion 101 and the liquid orifice 106.

Coupled to body portion 101 is an electrode cap portion 102. Electrode cap portion 102 may be fabricated from any suitable dieletric material, such as the PTFE-like material described above. The interface between body portion 101 and electrode cap portion 102 may be provided with a seal 112, such as an O-ring. Moreover, the body portion 101 and/or electrode cap portion 102 are molded or machined such that when they are fitted together, a circumferential space is maintained between them. An atomizing gas, provided via line 121 to internal gas channel 104 and into gas plenum 114, will travel in this space to a lower pressure region in the vicinity of the liquid orifice 106. In addition to internal gas channel 104, body portion 101 is further provided with a liquid channel 105, to which a liquid conduit 120 is connected. As described above in connection with the previously described embodiments of the nozzle, liquid conduit 120 may be provided with an adjustable ground wire mechanism to control the charge leakage upstream into the liquid source as a function of the length of the conduit $L_e$ and the length x of a contained wire. An interface or connection between liquid and gas conduits 120 and 121 with liquid and gas channels 105 and 104, respectively, may be made via rearward end 103 of body portion 101. FIG. 7 shows the rearward end 103 being made of, or surface coated with, a PTFE-like material.

Electrode cap 102 includes an electrode 108, embedded in the electrode cap 102, preferably forward or downstream of the liquid orifice portion 106. Electrode 108 may, as in the configuration of the nozzle shown in FIG. 7, be asymmetrically disposed in the electrode cap 102 in order, for example, to be more easily coupled to a wire 122 that in turn is coupled to a source of elevated voltage to raise the electrode 108 to a difference in electric potential relative to a liquid jet issuing from liquid orifice 106.

As in the embodiments shown in FIGS. 1 and 2, an inner cylindrical surface of induction electrode 108 forms a segment of the outer flow channel coaxially surrounding the liquid jet. Most preferably, this surface is smooth and absent any surface discontinuities that might disrupt the flow of gas.

Coupled to the front edge of the electrode cap 102 is an electric field barrier element 110. As described above, electric field barrier element 110 can be formed of any suitable material, and may be either coupled to a reference voltage or may be isolated from a reference voltage and thus be a "floating" field barrier. Although an electric field barrier 110 coupled to a reference voltage, such as ground, may provide a more effective barrier than one that is electrically floating, the former configuration is structurally more complicated, and may thus be more expensive to manufacture and use. The diminishment in effectiveness of a floating field barrier, as in the embodiment of FIG. 7, over a non-floating field barrier may therefore be negligible in comparison to the added costs associated with the manufacture and use of the device.

The embodiment of the field barrier 110 shown in FIG. 7 may be configured to join to the electrode cap 102 such that it is not easily removed. Furthermore, it can include an air gap 130, that may help prevent the leakage of charge that has built up on the field barrier 110 due to blocking the electric field of the spray cloud into the electrode cap 102. In addition to the air gap 130, the face of the field barrier 110 facing the electrode cap 102 in the vicinity of the air gap 130 may include a conductive or semiconductive layer or coating 132 in order to modify the properties of the field barrier 110 as a whole.

On the exterior of body portion 101 of the nozzle, a surface of low wettability 139 is provided in order to minimize or prevent charge leakage originating at electrode 108 over an external path. The low wettability surface 139 may be a PTFE-like substance and can be a cylindrical member disposed in a complementary recess in the exterior surface of the nozzle body, as shown. Alternatively, the low wettability surface 139 may be a surface treatment such as a coating or even a tape, provided that the surface treatment is closely coupled to the external surface of body portion 101 to prevent the presence of any contaminant, and therefore a charge leakage path, between the low-wettability surface 139 and the body portion 101.

Figure 8:
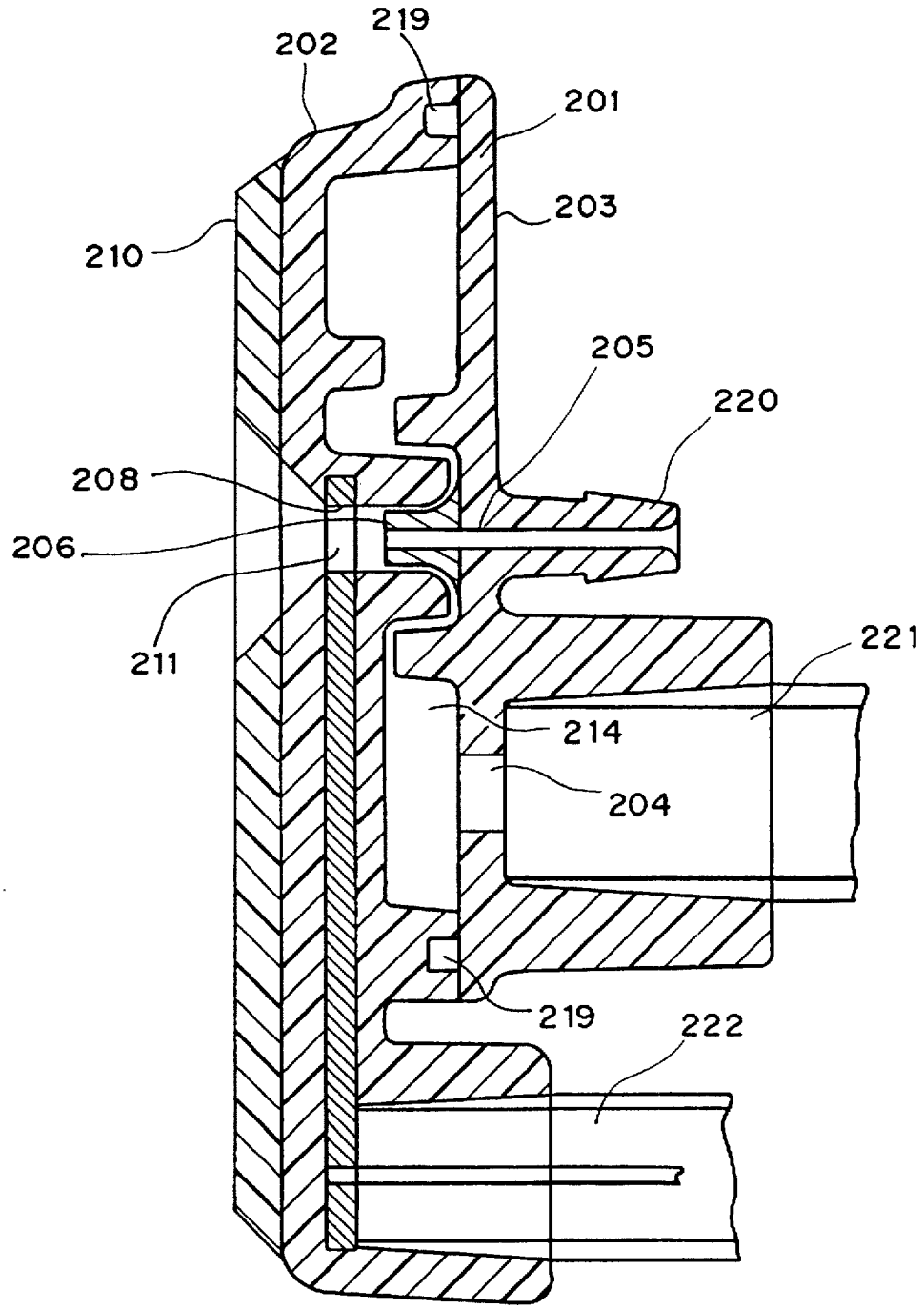
FIG. 8 is a cross-sectional elevational view of another embodiment of the induction spray charging nozzle apparatus according to the present invention.

Another embodiment of the nozzle according to the present invention is shown in FIG. 8. This embodiment of the nozzle uses elements having small cross section and is therefore better suited for manufacture by an injection molding process. As with the embodiment shown in FIG. 7, many of the components of the embodiment of FIG. 8 are analogous in function to those of the embodiments of FIGS. 1 and 2, differing primarily in their geometry. The analogous components are identified by reference numerals similar to those used to identify the analogous components of FIGS. 1 and 2, but are prefixed by 200 to identify them as relating to a different embodiment. The embodiment of the nozzle shown in FIG. 8 includes a nozzle body portion 201 that can be formed as a single piece of dielectric material by an injection molding process. Body portion 201 may include a liquid orifice portion 206, from which a liquid jet issues, as described above in connection with the embodiments of FIGS. 1 and 2 and FIG. 7. The liquid orifice portion 206 is preferably, although without limitation, joined to body portion 201 so as to minimize the likelihood of surface contaminants being introduced between them during use or maintenance. For this reason, it may be formed integral to body portion 201, for example, be press-fit into body portion 201, or be joined by any conventional means for snugly coupling mechanical components to preclude their disassembly. The seamlessness or near-seamlessness resulting from the integral or snugly coupled structure prevents or minimizes the likelihood of the introduction of contaminant matter between the body portion 201 and the liquid orifice 206, and consequently minimizes the possibility of the formation of an electric charge leakage path in an interface between the body portion 201 and the liquid orifice 206.

Coupled to body portion 201 is an electrode cap portion 202. Electrode cap portion 202 may be formed of any suitable dieletric material, such as the PTFE-like material described above. The interface between body portion 201 and electrode cap portion 202 may be provided with a seal 219. Moreover, the body portion 201 and/or electrode cap portion 202 are molded such that when they are fitted together, a circumferential space is maintained between them.

An atomizing gas, provided via line 221 to internal gas channel 204 and into gas plenum 214, will travel in this space to a lower pressure region in the vicinity of the liquid orifice 206. In addition to internal gas channel 204, body portion 201 is further provided with a liquid channel 205, to which a liquid conduit 220 is connected. As described above in connection with the previously described embodiments of the nozzle, liquid conduit 220 may be provided with an adjustable ground wire mechanism (not shown) to control the potential for charge leakage upstream into the liquid source as a function of the length of the conduit and the length of a contained wire.

Electrode cap 202 includes an electrode 208, preferably encapsulated in the cap 202, and located forward or downstream of the liquid orifice portion 206. Electrode 208 may, as in the configuration of the nozzle shown in FIG. 7, be asymmetrically disposed in the electrode cap 202 in order, for example, to be more easily coupled to a wire 222 that in turn is coupled to a source of elevated voltage to raise the electrode 208 to a difference in electric potential relative to a liquid jet issuing from liquid orifice 206.

As in the embodiments shown in FIGS. 1 and 2 and in FIG. 7, an inner cylindrical surface of induction electrode 208 forms a segment of the outer flow channel coaxially surrounding the liquid jet. Most preferably, this surface is smooth and absent any surface continuities that might disrupt the flow of gas.

Coupled to the forward surface of the electrode cap 202 is an electric field barrier element 210. In the present embodiment of the nozzle, electric field barrier element 210 is substantially flat and disk shaped, having a spray exit aperture that is formed therein and disposed coaxially with the spray exit aperture of electrode cap 202. The electric field barrier element 210 can be formed of any suitable material; in the illustrated embodiment, a dielectric disk is used on which a slight surface film forms a "floating" field barrier. Although an electric field barrier 210 coupled to a reference voltage, such as ground, may provide a more effective barrier than one of the floating variety, the former configuration is structurally more complicated, and thus more expensive to manufacture, use and service. The diminishment in effectiveness of a floating field barrier, as in the embodiment of FIG. 8, over a non-floating field barrier may thus be so small as to be negligible in comparison to the added costs associated with the manufacture and use of the device.

Figure 9:
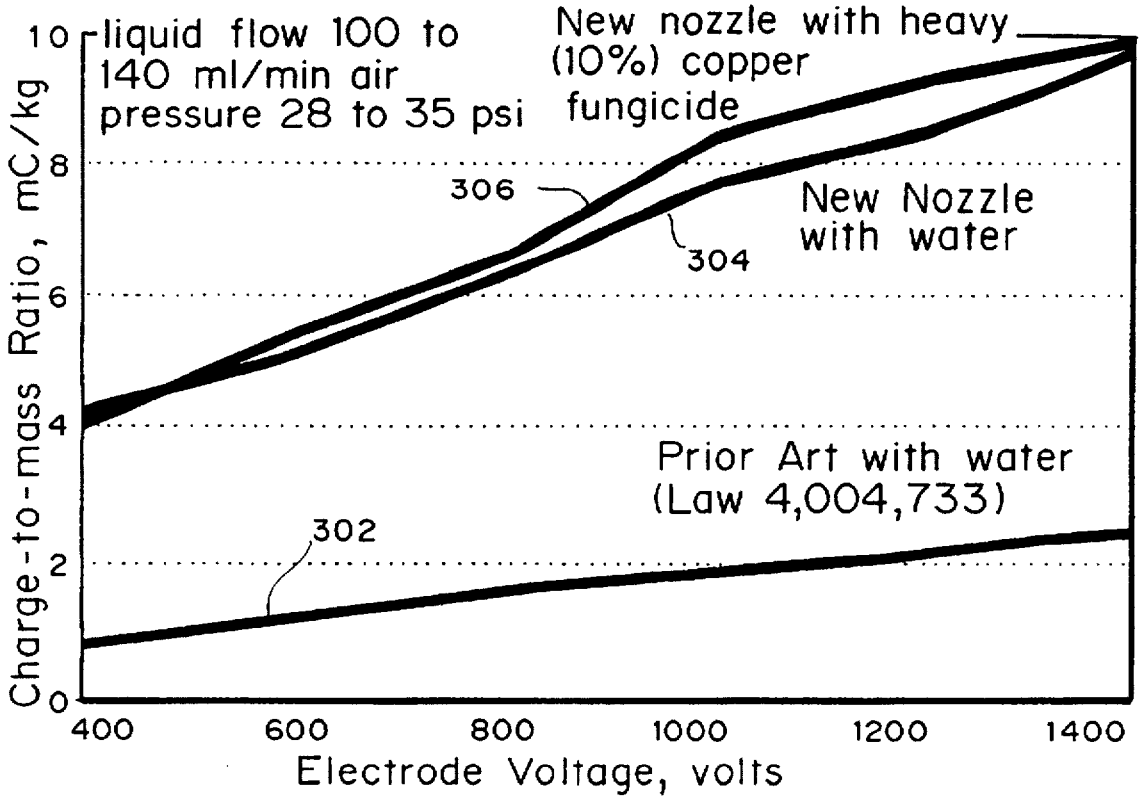
FIG. 9 is a graph showing the charging level achieved with a nozzle according to the present invention as compared with that of a prior art nozzle.
Figure 10:
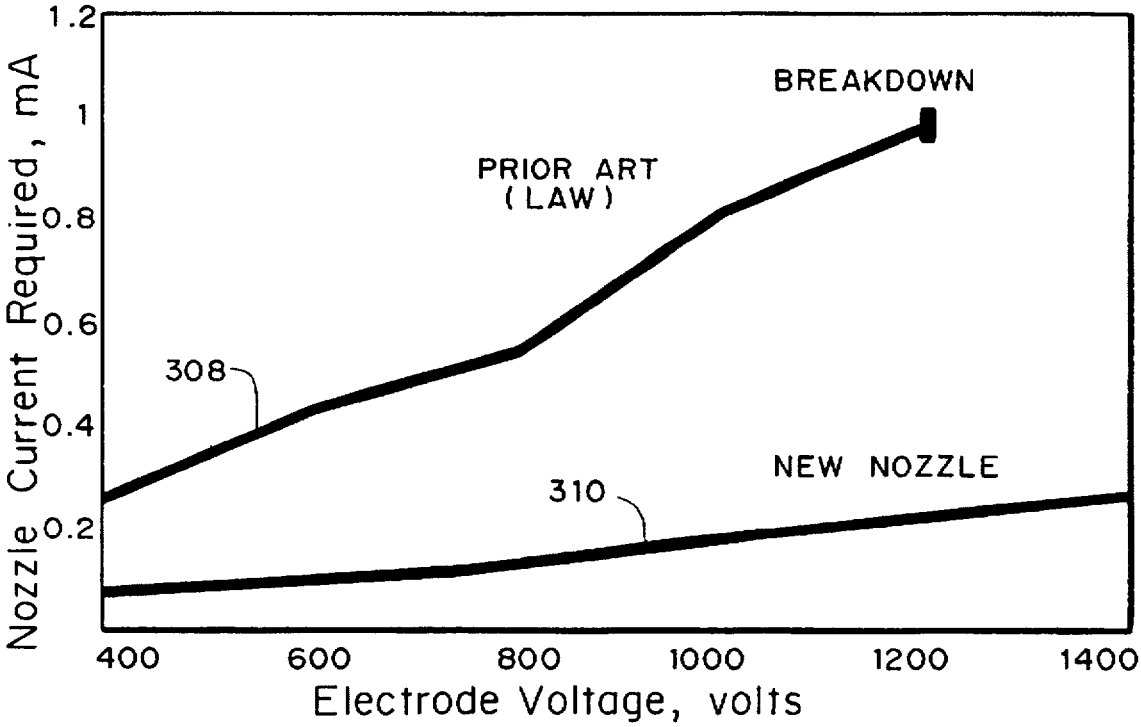
FIG. 10 is a graph showing the electrical power requirement for a nozzle according to the present invention as compared with that of a prior art nozzle.

The advantages of the electrostatic nozzle according to the present invention over those of the prior art are clearly illustrated in FIGS. 9 and 10. Those figures compare electrical charging and power requirements for the present invention with those of the nozzle disclosed in U.S. Pat. No. 4,004,733 to Law.

In FIG. 9, curves show the relationship of charge-to-mass ratio of the ejected spray cloud as a function of the voltage of the nozzle electrode. The results were obtained using a liquid flow rate of 100 to 140 ml/min and at a driving air pressure of 28 to 35 psi, which are both characteristic of the conditions under which electrostatic spraying nozzles are likely to be used. The results clearly illustrate the superior performance of the nozzle according to the present invention, which is capable of a four-fold improvement in charging over the prior art nozzle.

The charging performance of the prior art. Law device using water as a working fluid is shown by curve 302. For this prior art nozzle, the charge-to-mass ratio ranges from slightly under 1 mC/kg at an electrode voltage of 400 V, to about 2.5 mC/kg, at an electrode voltage of 1400 V. By contrast, the nozzle according to the present invention, achieves a charge-to-mass ratio approximately four times as great. When delivering water as shown at curve 304, the charge ratio achieved by the nozzle according to the present configuration is approximately 4 mC/kg (with the electrode at 400 V), ranging in a generally linear fashion up to approximately 10 mC/kg (for electrode voltages of 1400 V). Results for the delivery of a 10% solution of copper fungicide by the nozzle according to the present invention, as shown in curve 306, were similar. The results were even higher when electrode voltages between ranged between about 600 V and 800 V, and particularly over 1000 V.

The comparative electrical power requirements for the nozzle according to the present invention and for the prior art nozzle are provided in FIG. 10. The prior art Law nozzle, at curve 308, requires approximately 0.25 mA at a voltage 400 V to charge a solution of 10% copper fungicide spray. At 1200 V, the prior art nozzle breaks down. On the other hand, the nozzle according to the present invention, at curve 310, requires less than 0.1 mA of electrical current to deliver 10% copper fungicide spray at an electrode voltage of approximately 400 V. This relationship varies essentially linearly over the range of electrode voltages to a recorded peak of about 0.25 mA for an electrode voltage of about 1400 V.

The foregoing describes preferred embodiments of the present invention. Various changes and modifications to what is disclosed may be adopted or implemented without departing from the scope or spirit of the invention.

What is claimed is:

1. An electrostatic induction spray-charging nozzle device, the device being adapted for use with an electrical power supply, a liquid source and a gas source upstream of a rearward end of the device, comprising:

an electrically insulative body portion having a first channel therethrough for carrying a liquid from the liquid source, and a second channel therethrough for carrying gas from the gas source;

a liquid orifice tip in the body portion, the liquid orifice tip having an aperture aligned to receive and discharge liquid from the first channel of the body portion, the liquid being discharged from the liquid tip so as to meet with the gas in a droplet formation zone and form an atomized spray cloud;

a cap removably coupled to a forward end of the body portion, the cap comprising a spray exit aperture substantially coaxial to the liquid orifice tip aperture, an electrode forming a portion of the aperture, and an electrical connector within the cap for connecting the electrode to the power supply;

the body portion containing (1) no seam through which fluid may communicate with the first channel and (2) no electrical path between the first channel and the exterior of the body portion through which electrical charge may leak from the electrode to the liquid in the first channel; and at least one resilient seal located between the body portion and the cap and not in communication with the first channel in order to block any fluid communication between the liquid orifice tip of the body and the electrical connector in the cap.

2. The nozzle according to claim 1, wherein the liquid tip is formed integral to the body portion.

3. The nozzle according to claim 1, wherein the liquid tip is press fit into the body portion.

4. The nozzle according to claim 1, wherein the liquid tip comprises a material that is not readily flammable.

5. The nozzle according to claim 1, wherein the liquid tip comprises a PTFE-like material.

6. An electrostatic induction spray-charging nozzle device, being adapted for use with a liquid source and a gas source upstream of a rearward end of the device, the device coupled to an electrical power supply and to a reference voltage and comprising:

an electrically insulative body portion having a first channel therethrough for carrying a liquid from the liquid source, a second channel therethrough for carrying gas from the gas source, and a liquid orifice tip having an aperture aligned to receive and discharge liquid from the first channel of the body portion, the liquid discharging from the liquid orifice tip meeting with the gas in a droplet formation zone to form an atomized spray cloud that is ejected in a direction forward of the nozzle;

an electrode cap removably coupled to a forward end of the body portion, the cap comprising a spray exit aperture substantially coaxial to the liquid orifice tip aperture, an electrode forming a portion of the aperture and disposed in the vicinity of the droplet formation zone to create an electric field for electrically charging the atomized spray cloud as it is ejected to a location forward of the nozzle, and an electrical connector within the cap for connecting the electrode to the power supply;

the body portion containing (1) no seam through which fluid may communicate with the first channel and (2) no electrical path between the first channel and the exterior of the body portion through which electrical charge may leak from the electrode to the liquid in the first channel; and at least one resilient seal located between the body portion and the cap and not in communication with the first channel in order to block any fluid communication between the liquid orifice tip of the body and the electrical connector in the cap; and an electric field barrier disposed between the electrode and the charged spray cloud, for decoupling the electric field of the ejected spray cloud from the electric field of the droplet charging zone.

7. The device according to claim 6, wherein the electric field barrier is coupled to the reference voltage.

8. The device of claim 7, in which the electric field barrier is generally disk-shaped and has a spray exit aperture.

9. The device of claim 7, in which the electric field barrier is generally cup-shaped and has a spray exit aperture.

10. The device of claim 6, in which the electric field barrier is generally disk-shaped and has a spray exit aperture.

11. The device of claim 10, wherein the electric field barrier is adapted to form an air gap.

12. The device of claim 11, wherein the electric field barrier further comprises a conductive material applied to the electric field barrier adjacent the air gap in order to modify the electric field interception characteristics of the electric field barrier.

13. The device of claim 6, in which the electric field barrier is generally cup-shaped and has a spray exit aperture.

14. The device of claim 6, in which the electric field barrier and the coupling of the electric field barrier to the reference voltage are disposed entirely within the electrode cap and in which the electrode and the coupling of the electrode to the electric power supply are disposed entirely within the electrode cap, such that the electrode cap and the body share no electrical pathways.

15. The device of claim 14, further comprising a first charge conductor disposed in the body and coupled to the reference voltage, and a second charge conductor disposed in the body and coupled to the electrical power supply, both charge conductors disposed at predetermined locations in the body, such that when the body is coupled to the electrode cap, the first charge conductor makes electrical contact with an electrical coupling of the field barrier, and the second charge conductor makes electrical contact with an electrical coupling of the electrode only when the body is at a preselected angular position with respect to the electrode cap.

16. The device of claim 6, further comprising a current leakage reduction channel insert coupled to the electrode cap at the spray exit aperture, the insert extending forward of the electrode and extending rearward of the electrode to form the forward wall of the gas plenum chamber region.

17. The device of claim 16, in which the channel insert comprises two parts, a first part extending forward from the electrode and a second part extending rearward from the electrode.

18. The device of claim 17, in which the channel insert parts comprise a PTFE-like material.

19. The device of claim 18, in which the surface of the second channel part comprises at least one groove for lengthening the upstream surface path between the electrode and the liquid.

20. The device of claim 6, wherein the external surface of the electrode cap includes a groove disposed therein, the device further comprising a band received in the electrode cap external surface groove for interrupting charge leakage paths.

21. The device of claim 20, wherein the band comprises a PTFE-like material.

22. An electrostatic induction spray-charging nozzle device, having a first channel therethrough for carrying a liquid from a liquid source, a second channel therethrough for carrying a gas from a gas source, the two channels meeting in a droplet formation zone, and the device being further coupled to a liquid supply tube for carrying liquid to the first channel, to an electrical power supply, and to a reference voltage, the device comprising:

(a) a body portion through which the first channel is disposed, for carrying into the droplet formation zone the liquid to be atomized into spray droplets by gas carried by the second channel;

(b) an electrode cap comprising a dielectric material and having a forward end, a rearward end, the rearward end coupled to the body, further having a spray exit aperture through which the atomized liquid is discharged as a charged spray cloud;

(c) an electrode coupled to the electrical power supply and disposed within the electrode cap adjacent the droplet formation zone, for electrically charging the spray in the droplet formation zone; and (d) an electrically conductive grounding element electrically coupled to ground and in contact with the liquid stream and positioned at a selected distance upstream of the liquid orifice tip comprising a conductor inserted into the liquid supply tube and extending a selected distance downstream toward the liquid orifice tip to achieve a selected electrical resistance between the liquid jet of the droplet formation zone and the grounding element as determined by the resistance from the tip of the inserted conductor to ground, the liquid resistivity, the liquid supply tube resistivity, and the insertion distance downstream.

23. The device of claim 22 further comprising an electric field barrier means disposed between the electrode and the charged spray cloud and coupled to the reference voltage, for decoupling the electric field of the ejected spray from the electric field of the droplet charging zone.

24. The device of claim 22 comprising a PTFE-like material disposed on the nozzle surface between the electrode and ground to reduce current leakage.

25. An electrostatic induction spray-charging nozzle device, having a first channel therethrough for carrying a liquid from a liquid source, a second channel therethrough for carrying gas from a gas source, the two channels meeting in a droplet formation zone, and the device being further coupled to a liquid supply tube for carrying liquid to the first channel, to an electrical power supply, and to a reference voltage, the device comprising:

(a) a body portion through which the first channel is disposed, for carrying into the droplet formation zone the liquid to be atomized into spray droplets by gas carried by the second channel;

(b) an electrode cap comprising a dielectric material and having a forward end, a rearward end, the rearward end coupled to the body and coupled to the electrode cap, further having a spray exit aperture through which the atomized liquid is discharged from the body as a charged spray cloud;

(c) an electrode coupled to the electrical power supply and disposed within the electrode cap adjacent the droplet formation zone, for electrically charging the spray in the droplet charging zone;

(d) electric field barrier means disposed between the electrode and the charged spray cloud and coupled to the reference voltage, for decoupling the electric field of the ejected spray from the electric field of the droplet charging zone;

(e) a current leakage reduction means coupled to a surface of the nozzle;

(f) a short-circuit prevention and charge leakage reduction mechanism including:

(i) an electrically conductive grounding element electrically coupled to ground;

(ii) an electrically conductive insertion element, having a known resistance and electrically coupled to the grounding element, for inserting into the liquid supply tube to a preselected distance toward the liquid jet; and (iii) a tube coupling coupled to the grounding element and to the liquid supply tube and having an aperture through which the insertion element may pass from outside the tube coupling into the liquid supply tube;

the preselected distance of insertion of the insertion element determining the resistance of an electrical path from the liquid jet to ground for controlling nozzle charge leakage; and (g) an anti-drip auto-purge mechanism including a valve assembly coupled to the upstream end of the liquid supply tube, the valve assembly having a first position and a second position, wherein adjustment of the valve assembly from the first to the second position exposes the liquid supply tube to a change in pressure that evacuates the nozzle of liquid.

26. An electrostatic induction spray-charging nozzle device for use with a liquid source and a gas source comprising:

an electrode cap having a forward end, a rearward end, and an interior channel in the vicinity of which the liquid and gas from the liquid and gas sources meet to form an atomized spray, and having an electrode disposed adjacent the interior channel for electrically charging the atomized spray together with a conductor for connecting the electrode to a power supply, wherein the interior channel forms an internal nozzle charge leakage path, and the exterior surface of the electrode cap forms a first portion of an external nozzle charge leakage path, the charge leakage originating at the electrode;

a body portion coupled to the rearward end of the electrode cap and having an exterior surface forming a second portion of an external nozzle charge leakage path, and a liquid channel leading to a liquid orifice tip irremovably connected to the body portion;

a surface treatment having low surface wettability applied to a surface of the nozzle for interrupting a charge leakage path;

the body portion containing (1) no seam through which fluid may communicate with the liquid channel and (2) no electrical path between the liquid channel and the exterior of the body portion through which electrical charge may leak from the electrode to the liquid in the liquid channel; and at least one resilient seal located between the body portion and the cap and not in communication with the liquid channel in order to block any fluid communication between the liquid orifice tip of the body and the electrical connector in the cap.

27. The device of claim 26, wherein the surface treatment is a cylindrical band applied to the exterior surface of the nozzle.

28. The device of claim 27, wherein the cylindrical band comprises a PTFE-like material.

29. The device of claim 26, wherein the surface treatment is a cylindrical channel insert applied to the interior channel of the electrode cap.

30. The device of claim 29, wherein the cylindrical channel insert comprises a PTFE-like material.

31. The device of claim 26, wherein the surface treatment is a coating applied circumferentially about the exterior of the nozzle.

32. The device of claim 31, wherein the coating comprises a PTFE-like material.

33. The device of claim 26, wherein the surface treatment is a tape applied circumferentially about the exterior of the nozzle.

34. The device of claim 33, wherein the tape comprises a PTFE-like material.

35. An electrostatic induction spray-charging nozzle system for generating a charged spray from a liquid jet fed from a liquid source upstream of the nozzle device with reduced charge leakage, comprising:

an electrostatic spray-charging nozzle;

a liquid supply tube having an external portion for carrying liquid from the liquid source and an internal portion disposed within the nozzle for carrying the liquid from the external portion of the liquid supply tube to the nozzle jet, the portions of the liquid supply tube having a preselected combined length and cross-sectional liquid column area, and formed of a preselected material; and an electrical conductor placed in the liquid supply tube a preselected distance from the nozzle, extending a preselected distance in the liquid, and electrically coupled to electrical ground;

wherein the combined length, cross-sectional area, and material of the portions of the liquid supply tube, and the material and distance of the conductor to the liquid tip are selected such that the electrical resistance of an electrical path from the liquid jet to ground has a preselected value.

36. The device of claim 35 further comprising an electrical resistor placed between the conductor in the liquid supply tube and electrical ground.

37. An electrostatic induction spray-charging nozzle device, having a liquid supply channel therethrough for carrying a liquid from a liquid source to a liquid orifice tip, a second channel therethrough for carrying a gas from a gas source, the two channels meeting in a droplet formation zone, and the device being further coupled to a liquid supply tube for carrying liquid to the liquid supply channel, to an electrical power supply, and to a reference voltage, the device comprising:

(a) a body portion through which the liquid supply channel is disposed, for carrying into the droplet formation zone the liquid to be atomized into spray droplets by gas carried by the second channel;

(b) an electrode cap comprising a dielectric material and having a forward end, a rearward end, the rearward end coupled to the body, further having a spray exit aperture through which the atomized liquid is discharged as a charged spray cloud;

(c) an electrode coupled to the electrical power supply and disposed within the electrode cap adjacent the droplet formation zone, for electrically charging the spray in the droplet formation zone;

(d) an electrically conductive grounding element electrically coupled to ground and in contact with the liquid stream and positioned at a selected distance upstream of the liquid orifice tip; and (e) selectable porting to the liquid supply channel, upstream of the liquid orifice tip, for purging the channel of spray liquid to prevent electrical current between the electrode and ground through the liquid channel.

38. The device of claim 37 in which the selectable porting empties a portion of the liquid supply channel of spray liquid and fills the channel with a gas to prevent dripping from the liquid orifice tip and to prevent electrical current between the electrode and the upstream spray liquid.

39. The device of claim 37 in which the selectable porting is adapted to replace the spray liquid with an alternate liquid for the purpose of cleaning the liquid channel and reducing electrical current from the electrode.

40. The device of claim 37 where the selectable porting is adapted to replace the spray liquid with an alternate liquid and empty the alternate liquid from the nozzle.

* * * * *